US009113671B2

(12) United States Patent
Pfanner et al.

(10) Patent No.: US 9,113,671 B2
(45) Date of Patent: Aug. 25, 2015

(54) SAFETY HELMET, IN PARTICULAR FOR MOUNTAIN CLIMBERS AND TREE CLIMBERS

(71) Applicant: PFANNER SCHUTZBEKLEIDUNG GMBH, Hohenems (AT)

(72) Inventors: Anton Pfanner, Hohenems (AT); Martin Greber, Götzis (AT)

(73) Assignee: PFANNER SCHUTZBEKLEIDUNG GMBH, Hohenems (AT)

( * ) Notice: Subject to any disclaimer, the term of this patent is extended or adjusted under 35 U.S.C. 154(b) by 0 days.

(21) Appl. No.: 14/370,941

(22) PCT Filed: Dec. 19, 2012

(86) PCT No.: PCT/EP2012/076253
§ 371 (c)(1),
(2) Date: Jul. 7, 2014

(87) PCT Pub. No.: WO2013/104505
PCT Pub. Date: Jul. 18, 2013

(65) Prior Publication Data

US 2015/0040295 A1 Feb. 12, 2015

(30) Foreign Application Priority Data

Jan. 11, 2012 (DE) ..... 10 2012 000 370

(51) Int. Cl.
*A42B 3/14* (2006.01)
*A42B 3/12* (2006.01)
(Continued)

(52) U.S. Cl.
CPC ... *A42B 3/12* (2013.01); *A42B 3/08* (2013.01); *A42B 3/14* (2013.01)

(58) Field of Classification Search
CPC ..... A42B 3/14; A42B 3/04; A42B 3/10; A42B 3/085; A42B 3/142
See application file for complete search history.

(56) References Cited

U.S. PATENT DOCUMENTS 3,175,225 A * 3/1965 Lindblom ..... 2/416
3,668,704 A * 6/1972 Conroy et al. ..... 2/413
(Continued)

FOREIGN PATENT DOCUMENTS

DE 1797962 U 10/1959
DE 2826636 A1 1/1979
(Continued)

OTHER PUBLICATIONS

International Search Report Issued in PCT/EP2012/076253 on Mar. 28, 2013.

*Primary Examiner* — Bobby Muromoto, Jr.
(74) *Attorney, Agent, or Firm* — Fitch, Even, Tabin & Flannery LLP

(57) ABSTRACT

A protective helmet composed of a helmet shell in which interior fittings are fixed having an assembly contacting the user's head having a supporting cage, a head band and a neck strap. The interior fitting subassembly having three support arms protruding laterally downwards from the supporting cage in the temple areas or backwards and downwards in the area of the back of the head and formed as spacers as a way to affix to the helmet shell. The interior fitting subassembly is continuously held in a distance from the helmet shell along its entire outer circumference. A clearance which is therefore present around the interior fitting subassembly on all sides renders a relative dislocation of the helmet shell relative to the interior fitting subassembly possible. The free ends of the support arms are releasably attached to the helmet shell, respectively.

25 Claims, 35 Drawing Sheets

Figure 1:
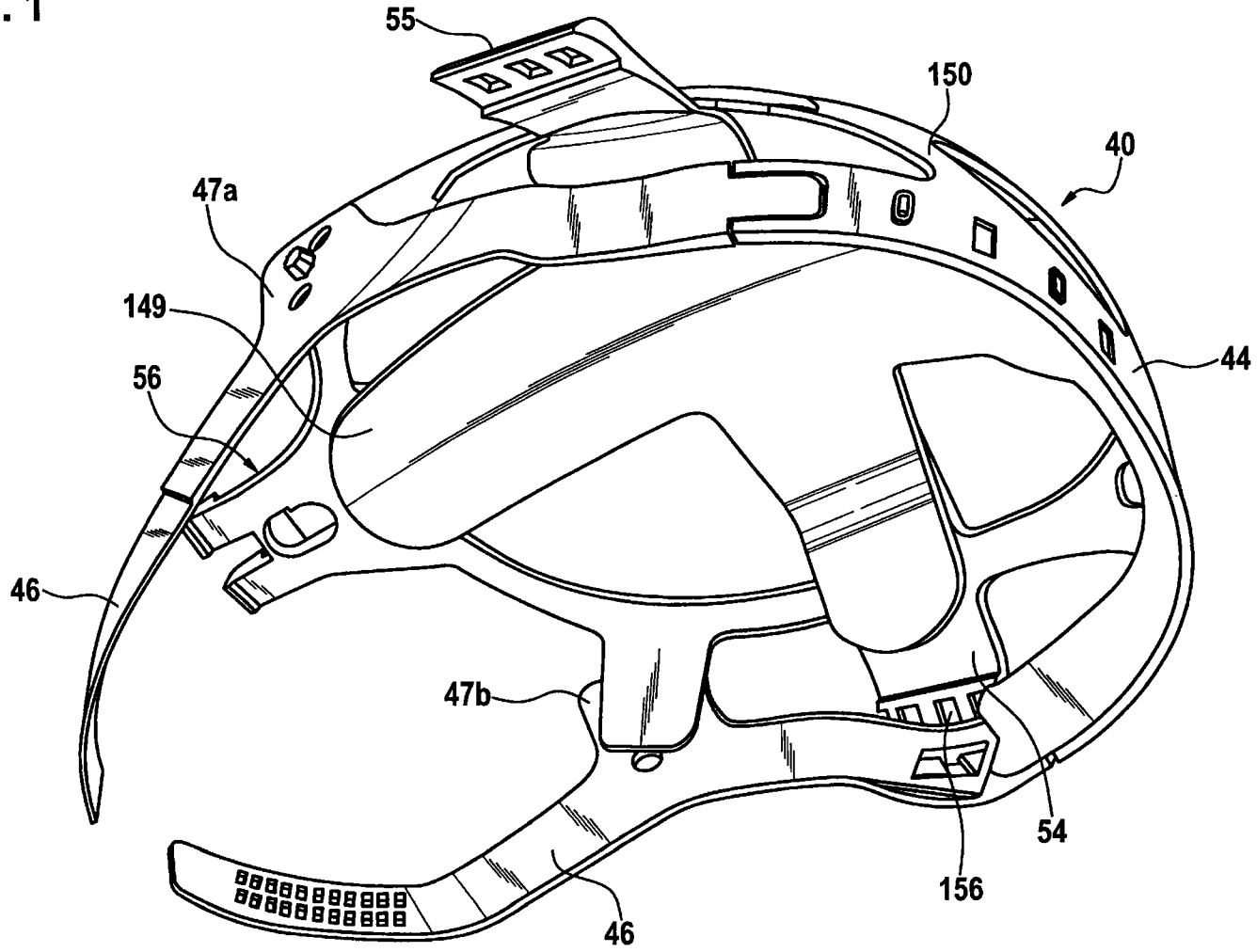

(51) Int. Cl.

| | |
|---|---|
| ***A42B 3/08*** | (2006.01) |
| *A42B 3/04* | (2006.01) |

(56) References Cited

U.S. PATENT DOCUMENTS

| | | | | | |
|---|---|---|---|---|---|
| 3,909,846 | A * | 10/1975 | Zahn | 2/416 |
| 4,222,123 | A | 9/1980 | Hellberg | |
| 4,224,694 | A | 9/1980 | Palmaer | |
| 4,547,908 | A | 10/1985 | Karlsson et al. | |
| 4,961,893 | A | 10/1990 | Rose | |
| 5,682,172 | A * | 10/1997 | Travers et al. | 345/8 |
| 5,794,272 | A * | 8/1998 | Workman et al. | 2/421 |
| 6,150,998 | A * | 11/2000 | Travers et al. | 345/8 |
| 6,292,953 | B1 * | 9/2001 | Beautz | 2/422 |
| 8,059,851 | B2 * | 11/2011 | Pfanner | 381/379 |
| 8,505,121 | B2 * | 8/2013 | Ahlgren et al. | 2/417 |
| 8,745,770 | B2 * | 6/2014 | Ahlgren et al. | 2/417 |
| 8,806,667 | B2 * | 8/2014 | Pfanner et al. | 2/424 |
| 2007/0269072 | A1 * | 11/2007 | Pfanner | 381/379 |
| 2010/0229286 | A1 * | 9/2010 | Ahlgren et al. | 2/416 |
| 2012/0278976 | A1 * | 11/2012 | Benton | 2/421 |
| 2012/0311752 | A1 * | 12/2012 | Ahlgren et al. | 2/8.2 |
| 2013/0191973 | A1 * | 8/2013 | Pfanner et al. | 2/421 |
| 2013/0205477 | A1 * | 8/2013 | Pfanner et al. | 2/416 |
| 2013/0205478 | A1 * | 8/2013 | Pfanner et al. | 2/421 |
| 2013/0212787 | A1 * | 8/2013 | Pfanner et al. | 2/424 |
| 2013/0219598 | A1 * | 8/2013 | Pfanner et al. | 2/423 |
| 2014/0033404 | A1 * | 2/2014 | Ahlgren et al. | 2/418 |
| 2014/0250572 | A1 * | 9/2014 | Greber et al. | 2/421 |
| 2015/0059057 | A1 * | 3/2015 | Pfanner et al. | 2/209.3 |

FOREIGN PATENT DOCUMENTS

| | | | |
|---|---|---|---|
| DE | 29707054 | A1 | 9/1979 |
| DE | 3314595 | A1 | 11/1983 |
| DE | 8714490 | U1 | 9/1988 |
| DE | 69811738 | T2 | 5/1994 |
| DE | 9410596 | U1 | 8/1994 |
| DE | 3590667 | C2 | 9/1996 |
| DE | 29708134 | U1 | 8/1997 |
| DE | 102004004044 | A1 | 10/2005 |
| DE | 102010027012 | A1 | 1/2012 |
| JP | 2007297743 | A | 11/2007 |
| WO | 2005027671 | A1 | 3/2005 |

* cited by examiner

SAFETY HELMET, IN PARTICULAR FOR MOUNTAIN CLIMBERS AND TREE CLIMBERS

CROSS REFERENCE TO RELATED APPLICATIONS

This application is a U.S. National Stage Application filed under 35 U.S.C. §§371 of International Application No. PCT/EP2012/076253, filed Dec. 19, 2012, which claims benefit of the priority date of German Application 10 2012 000 370.6, filed Jan. 11, 2012, which are hereby incorporated herein by reference in their entirety.

The invention relates to a protective helmet, particularly for mountaineers and tree climbers, comprising a helmet shell, interior fittings comprising a subassembly contacting the head of at least one supporting cage, one head band and one neck strap, and means for fixing this subassembly to the helmet shell.

A protective helmet of this type is known from the document DE 87 14 490 U1. This known protective helmet is a basic helmet adjustable to the different purposes under different service conditions by exchanging accessory elements. The protective helmet consists of a helmet shell and minimum interior fittings. The interior fittings are comprised of a crossed strap by means of which the helmet is worn on the head and which ensures a shock-absorbing clearance between the head and the helmet shell. The helmet is, at its outer circumference, provided with a protrusion spanning the lateral and the rear part of the helmet and having four recesses for fixing the crossed strap at the lower edge and further recesses for fixing additional accessory elements. The basic version of the helmet may be used as a simple universal helmet without any accessories. The accessories may be added or removed as required. At the broadest sections of the helmet, a recess is provided at the outside of the protrusion spanning the largest part of the helmet. This is the mounting position for a face and ear protection. This protection consists of a visor and two ear protectors which respectively comprise a wire bracket and an ear protection capsule. The face and the ear protection are fixed to the helmet from the outside by means of a common connecting element which is inserted into the protrusion. A disadvantage of a helmet kitted out like this is that, in service, obstacles the helmet passes may get caught behind the brackets of the ear protection and/or the visor and thus become an encumbrance to the wearer of the helmet in the field or rip the helmet off his head and thereby imperil the wearer.

Other documents describing the mounting of helmet accessories such as a face and/or ear protection on the outside of a protective helmet are the DE 28 26 636 C2, DE 29 07 054 A1, DE 33 14 595 C2, DE 35 90 667 C2, DE 94 10 596 U1 and DE 297 08 134 U1. With the protective helmets known from these documents the wearer of the helmet may also be hampered or imperilled on duty if obstacles get caught on the brackets of the ear and/or face protection.

Further documents concerned with the mutual fixation of interior fitting subassembly and helmet shell, not, however, with mounting helmet accessories on the outside of the helmet shell, are listed below.

From the document DE 10 2004 004 044 B4 a protective helmet is known in which the interior fittings comprising a subassembly contacting the head and comprised of a supporting cage, a head band and a neck strap are provided with connecting elements which are inserted into a shield which, in turn, is fixed on the lower edge of the helmet shell.

From the document DE 698 11 738 T2 a protective helmet is known in which the interior fittings comprising a subassembly contacting the head and comprised of a supporting cage, a head band and a neck strap are fixed with the aid of anchoring links which are inserted into slots at four positions in the lower edge of a double-walled helmet shell. The head band is made of a flexible material which can be easily adjusted to the size and shape of the head of the wearer.

From the document WO 2005/027671 A1 a safety helmet is known in which a shock absorption unit surrounding the remaining interior fittings and comprising a subassembly contacting the head and comprised of a supporting cage, a head band and a neck strap is disposed in the helmet shell. On the inner side of the helmet shell protrusions are provided on which the shock absorption unit and the interior fitting subassembly can be fixed by means of screws. In this known safety helmet the shock absorption unit is formed so thick that it is possible to provide a recess in which a transmitter/receiver having a connection line leading to the outside may be accommodated in its outer side facing the inner side of the helmet.

It is common to all the known protective helmets mentioned above that a force acting on the helmet from above is substantially fully transmitted to the head of the wearer of the helmet via the interior fittings and particularly via a supporting cage formed by a crossed strap. Namely, the crossed strap can only fulfill a shock absorption function to a certain degree because it has the additional function to tightly hold the helmet on the head of the wearer.

There is therefore also a demand for a protective helmet having an improved shock absorption capability.

It is further common to all known protective helmets mentioned above that a force acting on the helmet from the side is also substantially fully transmitted to the head of the wearer of the helmet. In all known helmets the interior fittings extend at least along the lower edge of the helmet directly to the helmet shell so that, at best, padded lace often present at the lower edge of the helmet between the interior fittings and the helmet shell could provide for some shock absorption.

Finally there is the problem that a protective helmet intended for mountaineers and tree climbers has to be provided with a chin strap. The chin strap has to be fixed at the inner side of the helmet shell and at the interior fitting assembly. If a pull is exerted on the chin strap, for example during a tensile test as required for a certification of the protective helmet, the position of the fastening points of the chin strap on the protective helmet has to remain stable. The interior fittings may therefore not become separated from the helmet shell during the tensile test. When the protective helmet is in use the chin strap has to safely keep the protective helmet on the head irrespective of an exposure to an external force or impact.

It is the object of the invention to design a protective helmet of the type mentioned in the beginning and known from the first mentioned document so that it has a substantially improved shock absorption capability both with respect to forces acting on it from above and to forces acting on it from the sides.

The shock absorption capability is also to be improved in a protective helmet which is the subject matter of the non-prepublished German patent application no. 10 2010 027 012.1. In this prior suggestion of the applicant a clearance is present around the interior fitting assembly which provides for a free space of up to approx. 4 cm between the interior fittings and the inner side of the helmet shell on all sides. In case of forces acting from the sides this clearance is used to reduce the impact energy by a deformation of the helmet shell and the interior fitting assembly. The standard in fact also requires a clearance between the upper side of the interior fitting assembly and the inner side of the helmet shell disposed above it, however, the known protective helmets therefore only afford protection against impacts occurring from above, if any at all.

According to the invention the object is solved by the fixation means comprising at least three support arms formed as spacers which project laterally downwards from the support cage into the temple area or backwards and downwards in the area of the back of the head, by the helmet shell and the support arms being dimensioned so that the interior fixation subassembly is continuously held in a distance from the helmet shell along its entire outer circumference so that a clearance extending around the interior fixation subassembly on all sides for accommodating helmet accessories comprising at least ear protection capsules along with supporting brackets and a tightening unit for the neck strap as well as mounting devices for the ear protection and for other helmet accessories comprising at least a face protection and a chin strap exists between the interior fitting subassembly and the helmet shell, by the supporting arms being releasably fixed to the helmet shell at their free end, respectively, and by the releasable fixation of the support arm protruding backwards and downwards comprising a latch fastener effective in a longitudinal direction of the same at a rear fixation point on or in the helmet shell, and, in addition, a mounting suspension of this support arm on an upper fixation point above the latch fastener on the inside of the helmet shell.

In the protective helmet according to the invention a neck strap tightening unit and mounting devices for at least an ear protection as well as ear protection capsules are located inside of the helmet shell so that the supporting brackets and retaining arms of the face and ear protection are disposed within the perimeter of the protective helmet so that it offers no possibilities for an engagement of obstacles such as branches and the like on its outside. If the ear protection is not needed it may, furthermore, be pivoted backwards inside the perimeter of the protective helmet within the clearance present between the interior fitting subassembly and the helmet shell so that the helmet offers even less engagement positions for obstacles. Since the mounting devices for the face protection are also disposed in the clearance the visor can be designed so that it offers engagement possibilities for obstacles such branches or the like neither in the tilted-up nor in the tilted-down state. The support arms arranged as spacers between the interior fitting subassembly and the helmet shell and the clearance formed thereby, due to a space of up to 4 cm being present between the interior fitting subassembly and the inner side of the helmet shell on all sides, offer the possibility to absorb a force acting on the helmet from the outside by a deformation of the helmet shell and the interior fitting subassembly so that the protective helmet according to the invention has an altogether better shock absorption capability because less force is transmitted to the head of the wearer. As already explained above, the force may be exerted on the helmet from above or from the side. In case of a lateral exertion of a force the shock absorption will then be achieved by pivoting and shifting the helmet shell relative to the interior fixation subassembly According to the invention, this is rendered possible by the, as compared to the state of the art, wide clearance between the interior fixation subassembly and the helmet shell in which not only the helmet accessories can be accommodated, but in fact also with the aid of the support arms connected to the helmet shell, which do not only act as spacers but will, under a tensile load applied by the helmet shell when a force is exerted on it from above or from the side, deform themselves and the supporting cage to which they are connected, and absorb the energy applied by the effects of the blow in this way, and thereby protect the head from the effects of the impact.

In the protective helmet according to the invention the wide free space present between the helmet shell and the interior fittings around the interior fittings renders the accommodation of helmet accessories comprising at least ear protection capsules of an ear protection and a tightening unit for the neck strap possible. In the protective helmet according to the invention the support and shock absorption functions are combined in the supporting cage made of a stiff, elastically flexible material in combination with the helmet shell having a certain elastic plasticity at least about its longitudinal axis. In fulfilling the shock absorption function, therefore, the supporting cage is supported by the helmet shell since the support arms protruding laterally downwards support the supporting cage on the helmet shell with their free ends so that in case of an external pressure acting on the helmet shell from above a tensile load is applied to the supporting arms by the helmet shell whereby the supporting arms are striving to deform the helmet shell towards the inside. When a force is acting on the helmet from the side the shock absorption function is additionally supported by the helmet shell which is only connected to the interior fittings at three fixation points and widely spaced apart from the interior fittings all around being dislocated relative to the interior fittings. As a result of this dislocation, but also in consequence of the tensile and compressive forces transmitted to the support arms of the interior fixation subassembly protruding laterally downwards via the helmet shell these support arms are deformed, whereby a shock impulse acting on the helmet is alleviated.

According to the invention the releasable fixation of the support arm protruding backwards and downwards comprises a latch fastener effective in its longitudinal direction at a rear fixation point on the helmet shell and a mounting suspension or support effective in its transverse direction at an additional fixation point located on the inside of the helmet shell in a distance to the latch fastener. In this way the support arm protruding backwards and downwards is prevented from giving up its snap-on connection to the helmet shell or from allowing the helmet shell more tolerance than absolutely required for the dislocation. The helmet shell is thus dislocated or pivoted in a controlled manner when a lateral force is applied, and impact energy is dissipated thereby. The shock absorption function is mainly achieved by an elastic deformation of the supporting cage and the supporting arms protruding laterally downwards which are attached to it in case of a dislocation or pivoting motion. The additional fixation point may be disposed above or below the latch fastener.

The support arm protruding backwards and downwards and its fixation on and in the helmet shell have an important function here, which will be explained in more detail here. The helmet shell has a substantially elliptical cross section. The longitudinal axis of the ellipse extends in the direction from the front side to the rear side or vice versa. The smaller curvature radius of the ellipse is therefore located at the front and rear ends of the helmet shell. If the helmet shell is deformed by an external force acting on it or from the inside by the interior fixation subassembly being distorted more force is required for the deformation where the radius is smaller, i.e. on the front and on the rear side, than where the curvature radius is larger, i.e. at the two long sides of the helmet shell. In the area in which the ellipse has the smaller curvature radius, i.e., for example, on the rear side, the helmet shell is capable of enduring a larger tensile force. If, as a thought experiment, the same tensile force was acting on all areas of the helmet shell, i.e. on the lateral sections as well as on the rear and front section, the deformation of the lateral sections towards the inside would be much more intense because smaller tensile forces are sufficient to this end. The support arm protruding backwards and downwards has a flatter angle relative to the helmet shell than the supporting arms protruding laterally downwards. Therefore, more deformation force is applied to the rear section of the helmet shell than to the lateral sections, approximately 50% on the rear side and respectively 25% in the lateral sections. This results in a main difference to all known helmets. If the effects of an impact from above act on a known helmet only the top of the known helmet will be deformed. Given the same effects of an impact, however, the helmet shell of the protective helmet according to the invention will be deformed altogether, i.e. not only in the upper section, but also in the lateral areas. Even though, on principle, the deformation energy is introduced into the entire helmet shell in the protective helmet according to the invention, it is also so that, as a result of the flat inclination of the support arm protruding backwards and downwards, and due to the smaller radius at the rear end of the helmet shell, a greater force transmission takes place at the rear fixation point where the free end of the support arm protruding backwards and downwards is fixed to the helmet shell than in the area of the long sides of the helmet shell so that an altogether stable force effect on the entire helmet shell is achieved.

The mounting suspension of the support arm protruding backwards and downwards provides for additional support on the helmet shell in case of an impact effect from above. Furthermore, this additional mounting suspension counteracts tensile forces acting on the interior fixation subassembly by the chin strap when it is exposed to strain.

Finally, the three-point-fixation between the interior fixation subassembly and the helmet shell preferred for the protective helmet according to the invention provides for the required degrees of freedom between helmet shell and interior fixation subassembly Their mutual dislocation enables a distortion of at least the two supporting arms protruding laterally downwards and, with it, a corresponding deformation of the helmet shell and the interior fixation subassembly so that the protective helmet has excellent shock absorption capabilities even with regard to the effects of lateral impacts.

The particular advantage the invention offers with regard to the force transmission within the helmet shell is also based on the finding that, for this purpose, three fixation points between the interior fixation subassembly and the helmet shell are optimum. If the mounting suspension of the helmet shell on the interior fixation subassembly is implemented at four or more points as in the state of the art the combination of helmet shell and interior fixation subassembly becomes extremely stable. They can hardly pivot or dislocate relative to each other so that their deformation which would contribute to the shock absorption will hardly occur.

The support arm protruding backwards and downwards is prevented from giving up its snap-on connection to the helmet shell or from allowing the helmet shell more tolerance than absolutely required for the displacement by the additional mounting suspension or support in case of an external force effect acting on the helmet shell and manifesting itself in a tensile load applied to this supporting arm. The helmet shell is therefore dislocated or pivoted relative to the interior fixation subassembly in a controlled manner when a lateral force is applied so that impact energy is dissipated.

The additional mounting suspension or support of the support arm protruding backwards and downwards on the helmet shell offers additional advantages in the tensile strength test required for certification which has to be passed by such protective helmets before they are approved for sale. In this tensile strength test it is, among other things, examined whether a chin strap which is mandatory in some helmets, for example, mountaineer's and tree climber's helmets, is capable of separating the entire helmet from the head of the wearer at a prescribed tensile load. The mounting suspension does not only lead to a stabilisation of the fixation of the support arm protruding backwards and downwards on the helmet shell but also absorbs a large part of the force during the peeling test and prevents the supporting arm protruding backwards and downwards from being stained by the tensile load to the point that it gives up its snap-on connection to the helmet shell. The angle formed by the support arm protruding backwards and downwards and the longitudinal axis of the helmet shell is very flat so that a higher tensile force is applied to this supporting arm in case of a force acting on the helmet from above and may therefore render a correspondingly substantial contribution to the shock absorption in case of strain from above. Owing to the stabilisation resulting from the mounting suspension the tensile force absorption capacity of the support arm protruding backwards and downwards is considerably improved. According to the state of the art described in the beginning, for example according to the document DE 1 797 962 U1, the angle formed by the support straps on the supporting cage and the inner side of the helmet is so acute, that, in case of a force being applied from above, the force is virtually introduced into the helmet shell in the direction of the helmet shell via the support straps. Forces introduced into the helmet shell in this way are, of course, not capable of supporting the shock absorption function because they do not create any tendency to deform towards the inside in the area of its long edges. In the state of the art a substantial inwards deformation of the helmet shell would be rather counterproductive anyway because, other than in the protective helmet according to the invention in which an up to at least about 4 cm wide clearance is present between interior fittings and helmet shell on the level of the lower edge of the helmet shell. The helmet shell is already located very close to the head of the wearer of the helmet in the initial state The clearance permits a considerable deformation of the helmet shell towards the inside without there being the risk of the helmet shell contacting the head. It is rather ensured that in consequence of its deformation a substantial part of the impact energy is dissipated. The preferred three-point fastening of the helmet shell on the interior fixation subassembly and the wide clearance between them set the stage for this in the protective helmet according to the invention.

In case of a lateral load acting on the helmet shell the conditions in terms of shock absorption are even less favourable than in case of strain applied from above in the known protective helmets. In the known helmets as discussed in the beginning, typically, the interior fittings are mounted directly on the lower side of the helmet edge If a blow from the side acts on the helmet shell this blow will be directly transmitted to head. The fact that sometimes a padded lace is present between the helmet shell and the interior fittings on the level of the lower edge of the helmet shell like, for example, in the helmet according to the abovementioned document DE 1 797 962 U1 will be of no assistance either since such padded lace has only a small thickness and can therefore be compressed almost without resistance by the helmet shell moving inwards.

Advantageous embodiments of the protective helmet according to the invention from the subject matter of the sub-claims is.

In one embodiment of the protective helmet according to the invention an intermediate part of the support arm protruding backwards and downwards positioned in the clearance is fixable or fixed to a retaining part on the helmet shell disposed above or below it in a distance for connecting the support arm protruding backwards and downwards to the additional fixation point. In this way the supporting arm protruding backwards and downwards is, even under the most adverse force effect conditions acting on the helmet shell, prevented from giving up its snap-on connection to the helmet shell or from allowing the helmet shell more than the tolerance absolutely required for a dislocation relative to the interior fixation subassembly The additional fixation of the intermediate part of the supporting arm protruding backwards and downwards located in the clearance to a retaining part on the helmet shell located above it in a distance may, for example, be implemented by an arm extension, bridge or the like integrally formed on the intermediate part and establishing a substantially rigid connection between the intermediate part and the retaining part located above it on the helmet shell.

In another embodiment of the protective helmet according to the invention the supporting cage is formed of a stiff, elastically flexible material. In the protective helmet according to the invention the support and the shock absorption function are combined in the supporting cage of a stiff, elastically flexible material and the supporting arms protruding from it of the same or the identical material in this embodiment. In fulfilling the shock absorption function the supporting cage is supported by the helmet shell because the supporting arms protruding obliquely downwards or backwards support the supporting cage on the helmet shell with their free ends so that at least the laterally protruding supporting arms are exposed to a tensile load by the helmet shell and strive to deform the helmet shell towards the inside down to the lower edge at its long sides when an external pressure acts on the helmet shell from above.

In another embodiment of the protective helmet according to the invention the mounting device for the chin strap comprises two chin strap fastening points on the inside of the helmet shell to which suspension links of the chin strap can be connected and a rear chin strap fastening point on the interior fitting subassembly. The position of these fixation points for the chin strap ensures a safe fixation of the same.

In another embodiment of the protective helmet according to the invention the rear chin strap fixation point comprises an aperture in the support arm protruding rearwards and downwards to which another suspension link of the chin strap can be attached. The chin strap can thus be fixed to the interior fitting subassembly in a simple manner after the assembly of the interior fitting subassembly in the helmet shell. The use of suspension links in the three fixation points of the chin strap renders their convenient exchangeability possible, for example for cleaning purposes.

In another embodiment of the protective helmet according to the invention the supporting cage comprises, at its lower edge, a peripherally closed support strip on which the support arms are integrally formed. In this embodiment the supporting arms and the support strip form an integral component having the required stiffness and yet offering a sufficient shock absorption effect together with the remaining part of the supporting cage. Particularly in the area between this support strip and the helmet shell the latter is spaced apart from the supporting cage by at least about 4 cm along its entire circumference.

In another embodiment of the protective helmet according to the invention the neck strap is attached to the supporting cage and has two ends releasably connected in the neck area by a tightening unit accommodated in the clearance as another helmet accessory. The neck strap is thus also protected against the external effect of obstacles and still conveniently accessible for the operation by the wearer of the helmet.

In another embodiment of the protective helmet according to the invention the tightening unit comprises a supporting shell which can be tightened against the back of the head of the wearer of the helmet when tightening the neck strap with the aid of a latch flap. This embodiment ensures a reliable one-hand operation and, above that, permits the fixation of the interior fitting subassembly on the head in a simple manner. The use of a chin strap will then offer additional safety.

In another embodiment of the protective helmets according to the invention the chin strap is lead backwards to the tightening unit from the two front chin strap fixation points, ran through the supporting shell on both sides, and finally brought together at the rear chin strap fixation point. When a tensile load is applied to the chin strap its end which is attached to the supporting arm protruding backwards and downwards will pull downwards on the supporting cage. Directly above or below it the additional fixation point is located in which the supporting arm protruding backwards and downwards is suspended or supported on the inside of the helmet shell. The tensile force of the chin straps acting downwards is absorbed by the helmet shell in this way. The chin strap obtains the downwards direction of its tensile force by being led through the tightening unit in its sector located in front of the rear fixation point.

In another embodiment of the protective helmet according to the invention the support arms protruding laterally downwards in the two temple areas comprise means for a releasable fixation on the inside of the helmet shell. The interior fitting subassembly can therefore be readily and releasably attached to the helmet shell.

In another embodiment of the protective helmet according to the invention the fixation means on each of the support arms protruding laterally downwards are formed so that they can be brought in a positive engagement with the helmet shell. In this way, a force can be transferred through the mounting position for the interior fitting subassembly on the inside of the helmet shell in a simple manner.

In another embodiment of the protective helmet according to the invention the support arm protruding backwards and downwards comprises a locking device for a fixation of the support arm to the helmet shell for its latch lock at its free end. In this embodiment the helmet shell may simply have an aperture into which the free end of the above supporting arm is inserted so as to be latched to the helmet shell so as to be capable of transferring a force via the mounting position.

In another embodiment of the protective helmet according to the invention the fixation means on each of the supporting arms protruding laterally downwards comprises through-holes respectively encompassing rod-like protrusions on the helmet shell on a length at least equal to the inner width of the through-holes so that a force exerted to the supporting arms protruding laterally downwards as a result of a load acting on the helmet from above generates a momentum at these supporting arms which strives to deform the helmet shell towards the inside as far as to the lower edge. In this embodiment thus the shock absorption function of the interior fitting subassembly can be supported in a simple manner by the elastic deformation of the helmet shell. The through-holes at the free ends of the supporting arms are adjusted depending on the rod-like protrusions so that a leverage effect can be exerted on the rod-like protrusions when a force acts on the helmet shell. Here, the support of the shock absorption function will not only take place when a force acts on the helmet from above but also when a force is exerted on the helmet from the side.

In the latter case a controlled dislocation or pivoting of the helmet shell relative to the interior fixation subassembly will lead to a tendency of the supporting arms to become distorted and therefore also of the supporting cage to become distorted which considerably contributes to the shock absorption. What is helpful here is that the supporting arms are designed so that they are extremely wide which facilitates their distortion by the helmet shell when they are dislocated or pivoted relative to the interior fixation assembly.

In another embodiment of the protective helmet according to the invention the supporting cage comprises two support arms protruding downwards to which the neck strap is respectively fixed on a selectable level. In this way the fit of the protective helmet can be improved in a simple manner.

In another embodiment of the protective helmet according to the invention the support arms and the support arms are further stiffened by integrally formed ribs. In this way, the force transmission via the mounting position can be ensured in a simple manner.

In another embodiment of the protective helmet according to the invention the intermediate part of the support arm protruding backwards and downwards disposed in the clearance is provided with at least one bridge protruding upwards or downwards for the additional mounting suspension or support in the additional fixation point on the helmet shell. The bridge ensures that a force exerted when a force acts on the support arm protruding downwards from above via the helmet shell will not only act on the free end of this support arm which is latched to the helmet shell but also on the intermediate part of this support arm disposed in the clearance. In case of a lateral force acting on the helmet the bridge will act as a stabiliser because it permits a dislocation or pivoting movement of the helmet shell relative to the interior fixation subassembly in case of a lateral force acting on the helmet shell but will prevent the snap-on connection between the supporting arm protruding backwards and the helmet shell from being released, loosened or becoming appreciably dislocated.

In another embodiment of the protective helmets according to the invention the bridge is integrally formed with the supporting arm protruding backwards and downwards. Since the supporting cage is preferably made of a plastic material and the supporting arm protruding backwards is integrally formed with the supporting cage the bridge can be integrally formed with the supporting cage in a simple manner.

In another embodiment of the protective helmets according to the invention the free end of the bridge is formed so that it is positively fixable to the retaining part on the helmet shell. This is the most effective way to accomplish that the bridge attached to the inside of the helmet shell behaves like the helmet shell and that their mutual connection can be readily designed so that can be easily detached, for example when dismounting the interior fitting subassembly from the helmet shell.

In another embodiment of the protective helmet according to the invention the supporting arm protruding backwards and downwards is bifurcated at its free end and latched on the helmet shell with both bifurcated ends thus formed and provided with a pair of the bridges which are aligned in parallel with respect to each other and spaced apart by the width of the arm in its intermediate part. This renders latching the fork-like free end in an aperture in the helmet shell possible in a simple manner while rapidly fixing the entire width of the supporting arm protruding backwards and downwards to the pair of bridges on the inside the helmet shell.

In another embodiment of the protective helmet according to the invention the support arms protruding laterally downwards form an angle in a range of approximately 30°-50° together with a straight line extending transversely relative to the longitudinal axis of the supporting cage and through the free ends of these support arms. Within this range, an optimum value for the force effect in terms of the desired support of the shock absorption function can be selected. A preferred value is approximately 45°.

In another embodiment of the protective helmet according to the invention the support arm protruding backwards and downwards forms an angle in a range of about 15°-25° with the longitudinal axis of the supporting cage. A preferred value is approximately 20°.

In another embodiment of the protective helmet according to the invention the support arms protruding laterally downwards are arrow-shaped in the forward direction and formed on the supporting cage in front of a central transverse axis of the supporting cage. The supporting arms protruding laterally downwards therefore do not protrude straightly sideward but transversely forward in this embodiment. In this way the forces can be more optimally distributed on the helmet shell from the pivot points. The good distribution of the forces on the helmet shell provides for the same being substantially evenly deformed all around.

In another embodiment of the protective helmet according to the invention the helmet shell comprises ventilation openings and guide slots for retaining elements of a ventilation gate at least in an area following the snap-on connection point of the support arm protruding backwards in the forward direction. The ventilation openings render a good ventilation of the clearances present between the helmet shell and the interior fixation subassembly possible. The guide slots enable the ventilation gate to be releasably and shiftably mounted on the helmet shell by means of retaining elements mounted on its bottom side.

In another embodiment of the protective helmet according to the invention the retaining elements of the ventilation gate comprise a pair of angle elements in its front section and a pair of resiliently deflectable retaining arms in its rear section which are shiftably and releasably held in their associated guide slots. A releasable installation of the ventilation gate on the helmet shell is therefore possible in a simple manner.

In another embodiment of the protective helmet according to the invention the ventilation gate is formed so that it shields the section of the helmet shell in which the support arm protruding backwards and downwards is fixable or fixed from the effects of impacts from the outside.

Figure 2:
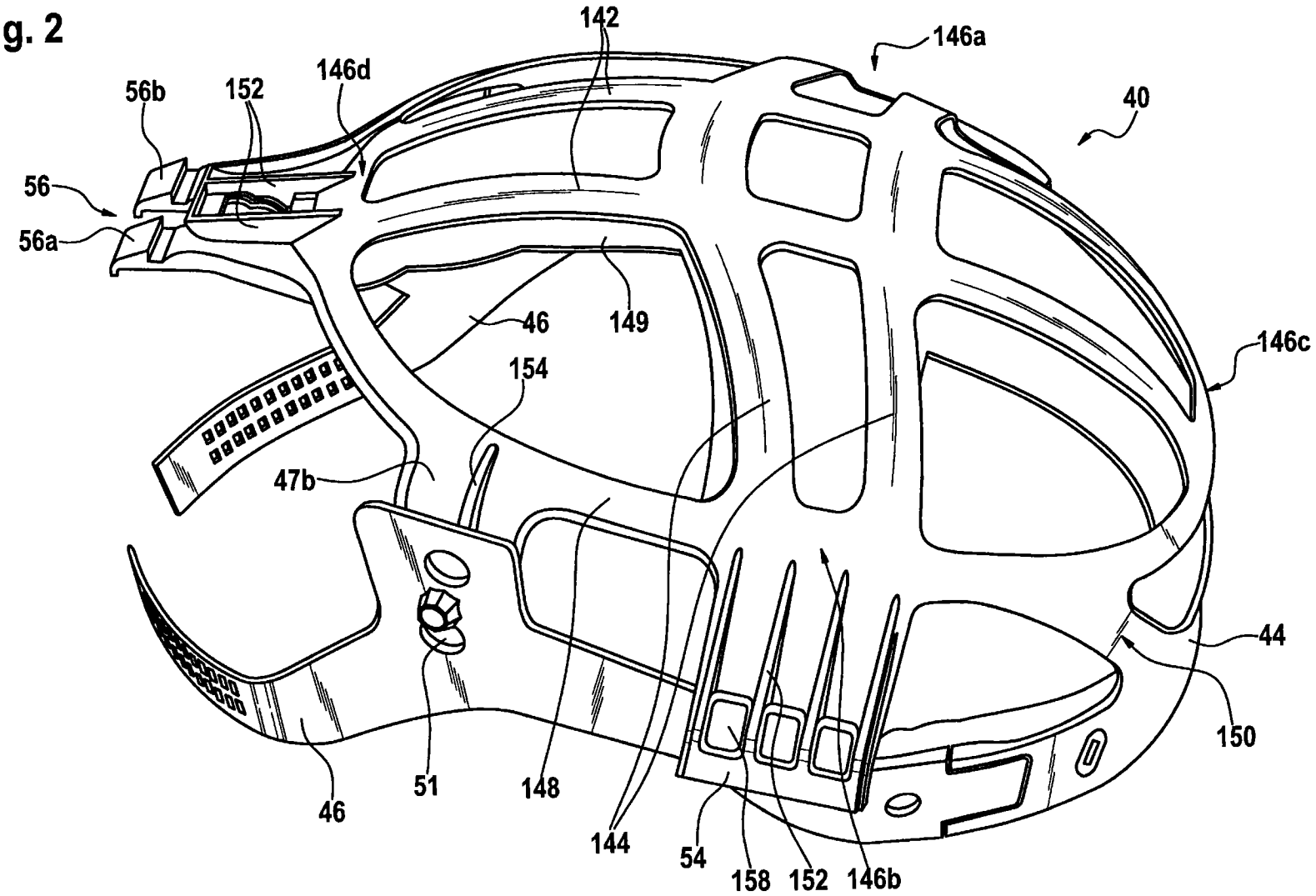
Figure 3:
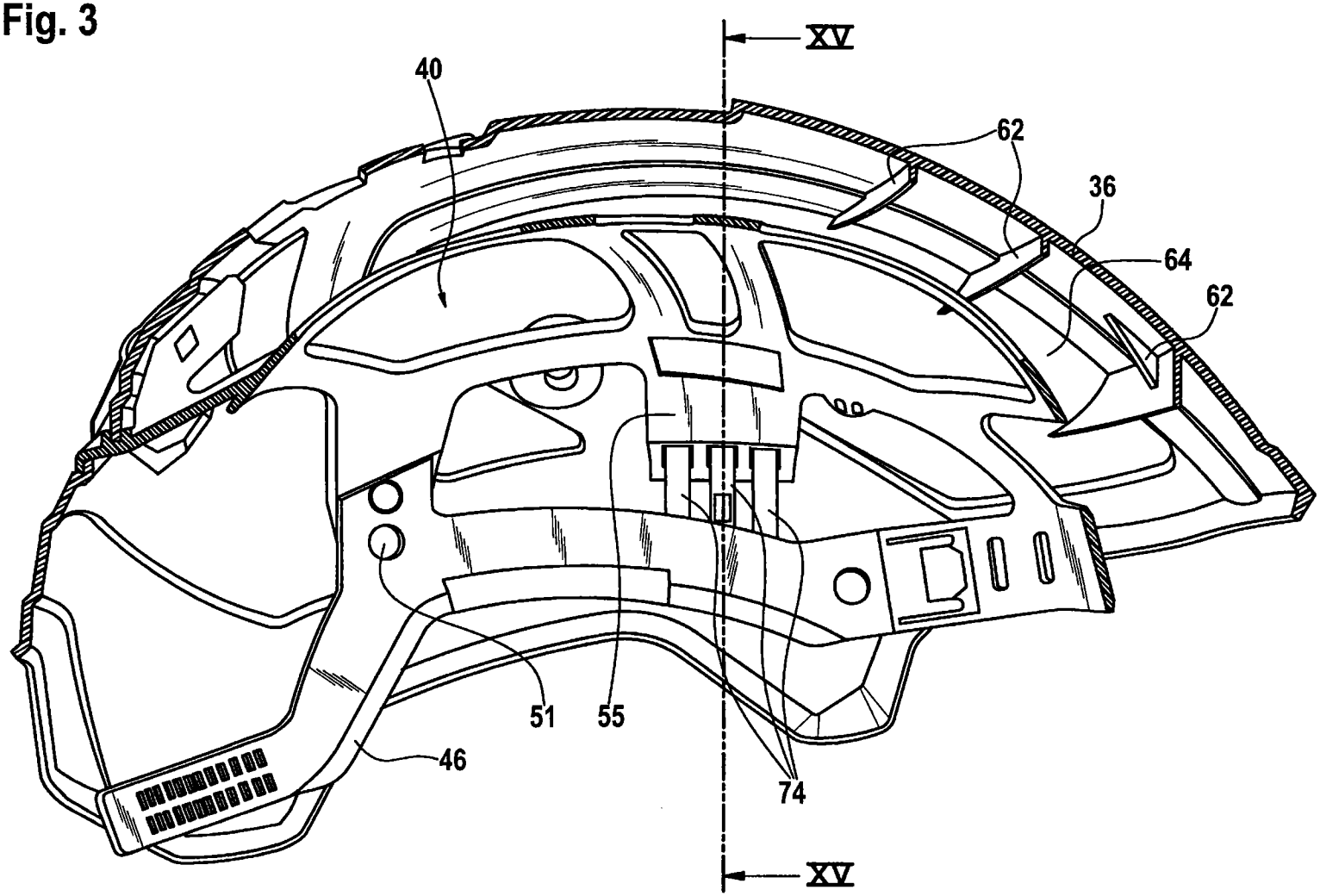
Figure 4:
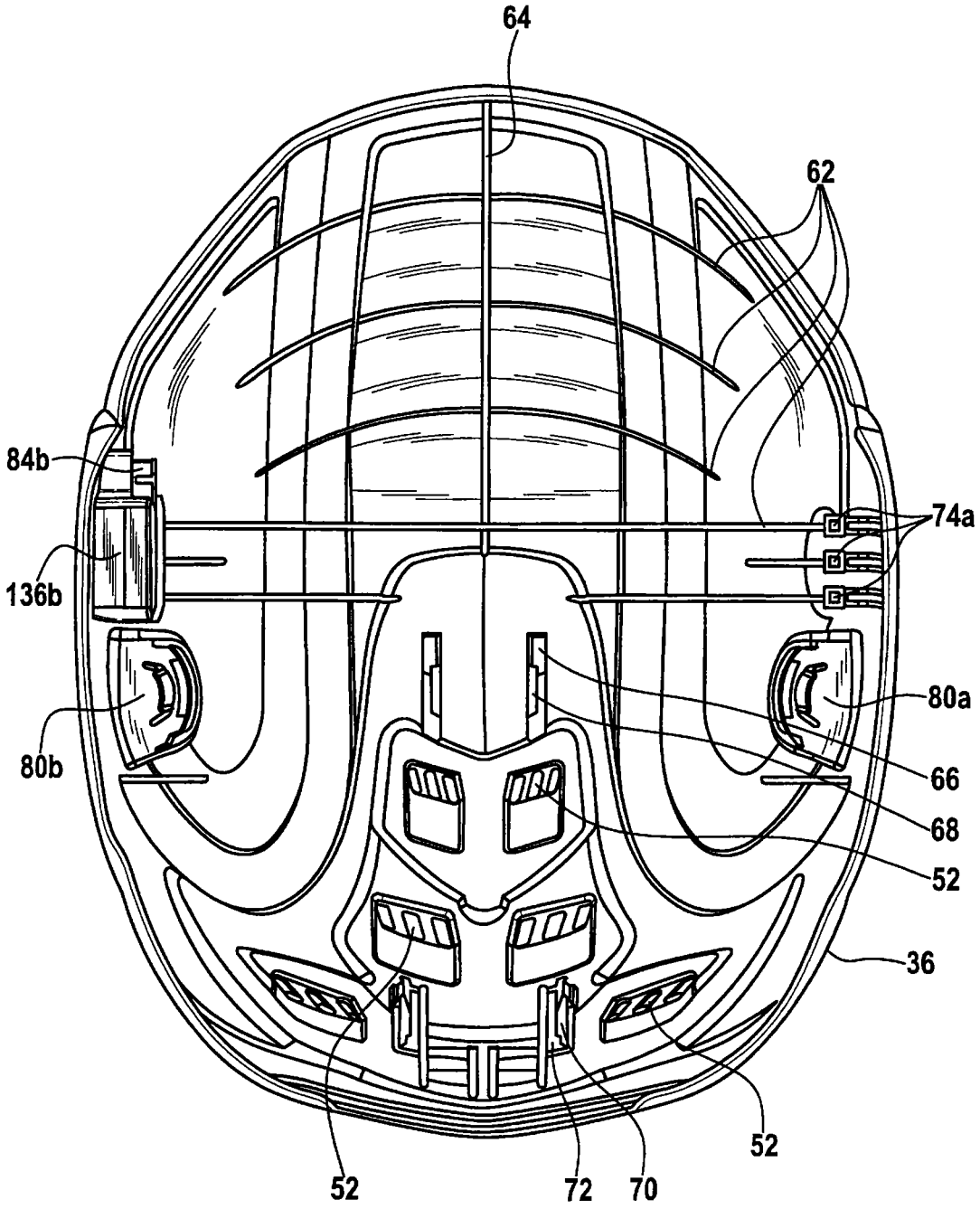
Figure 5:
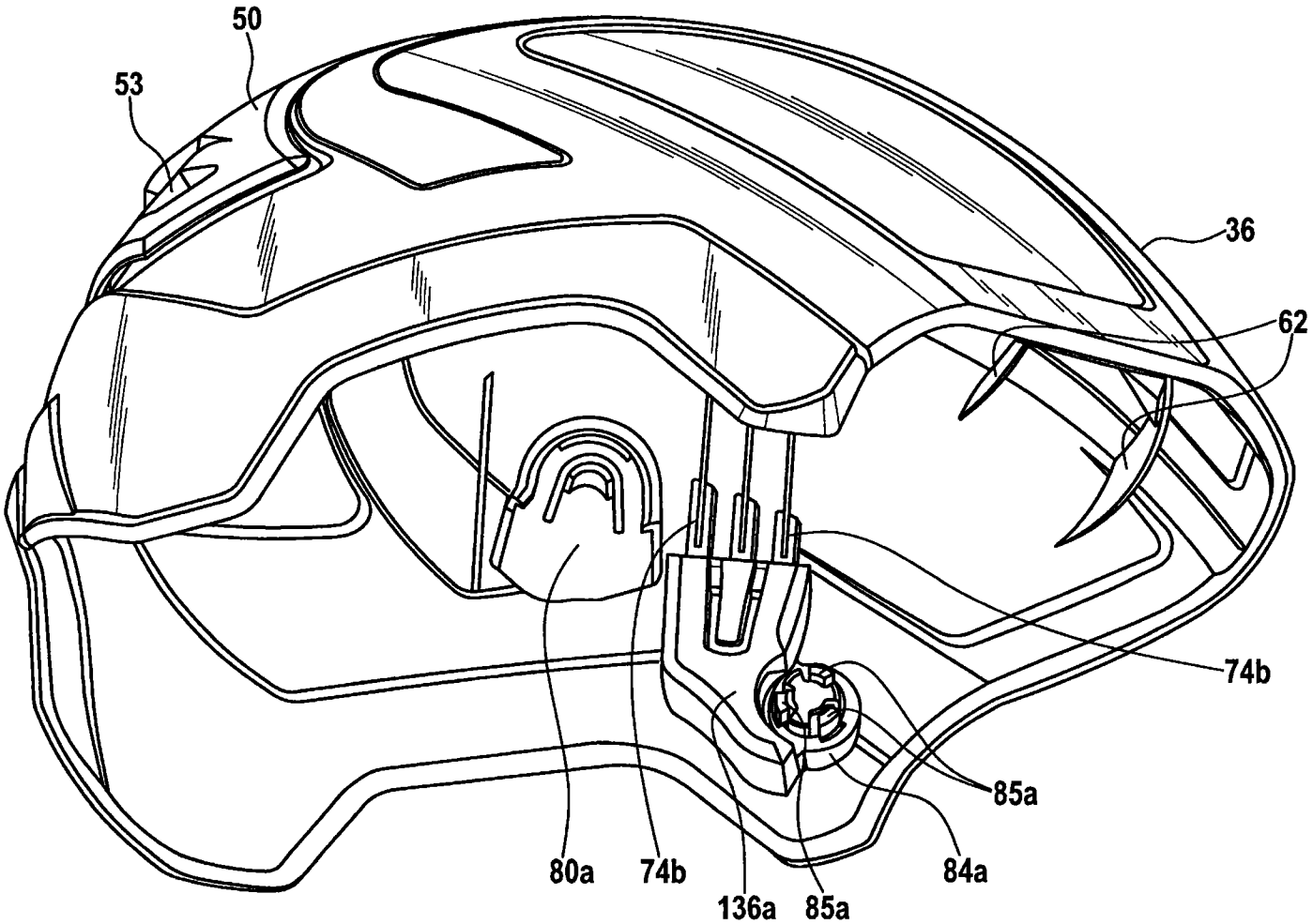
Figure 6:
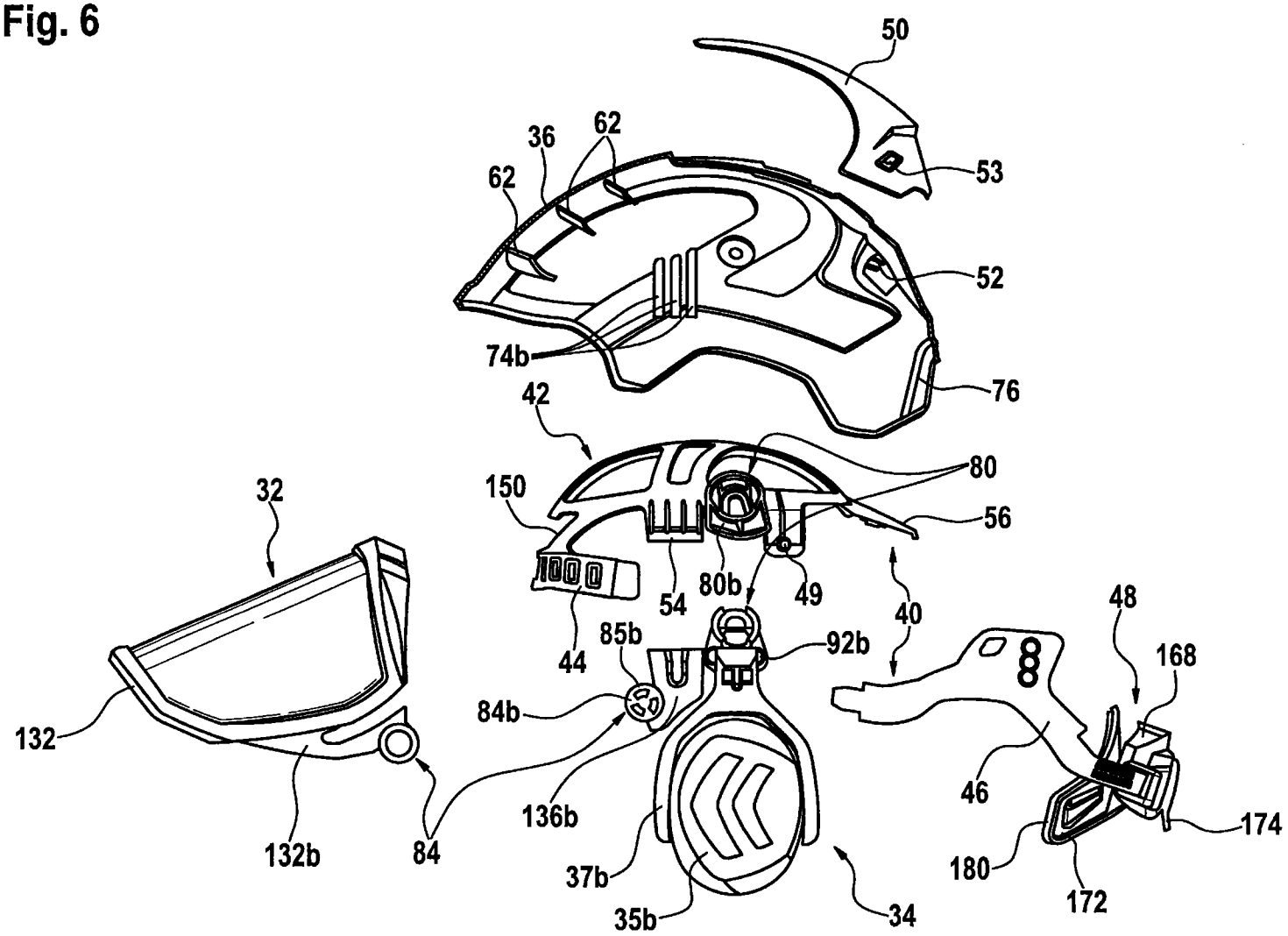
Figure 7:
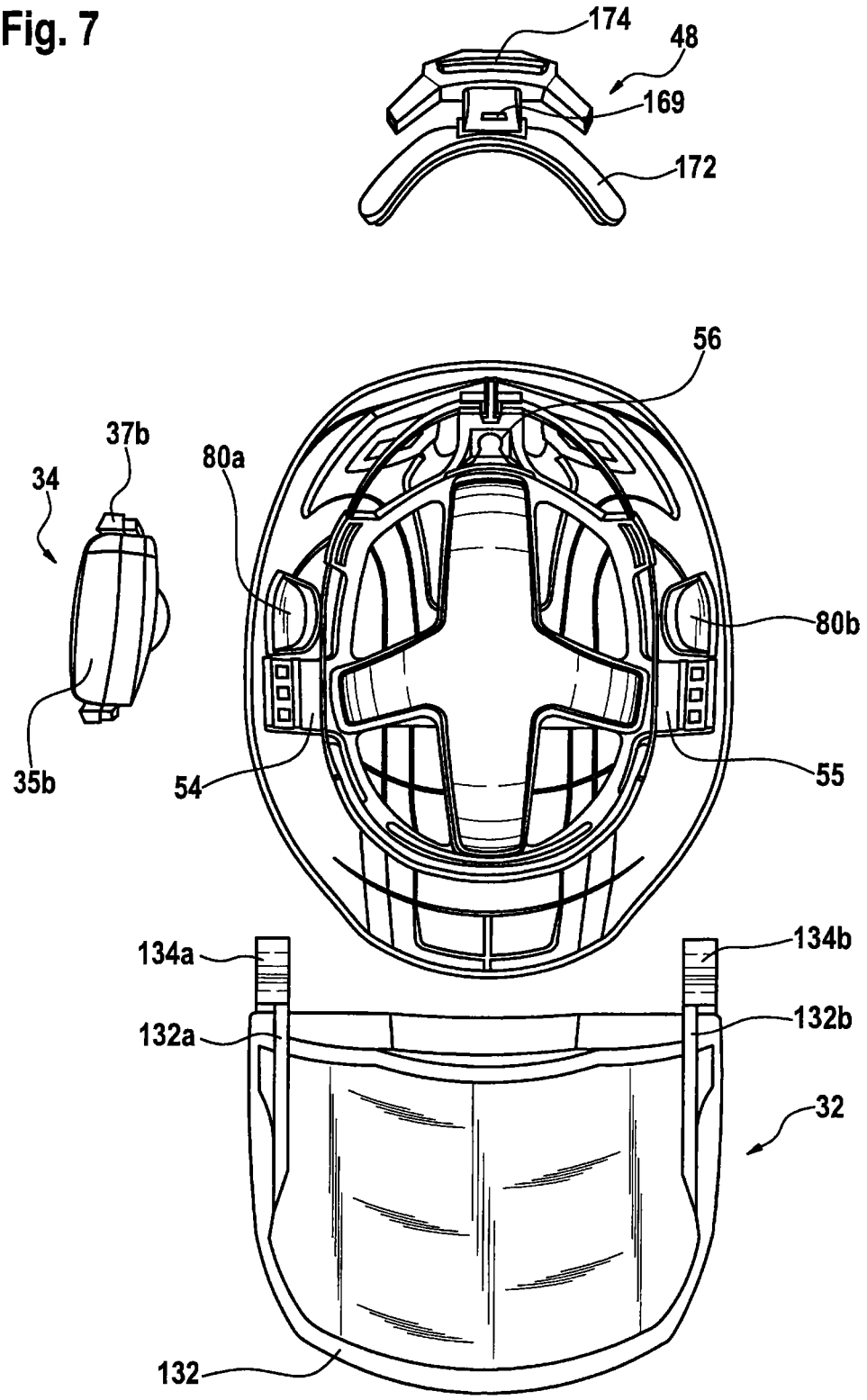
Figure 8:
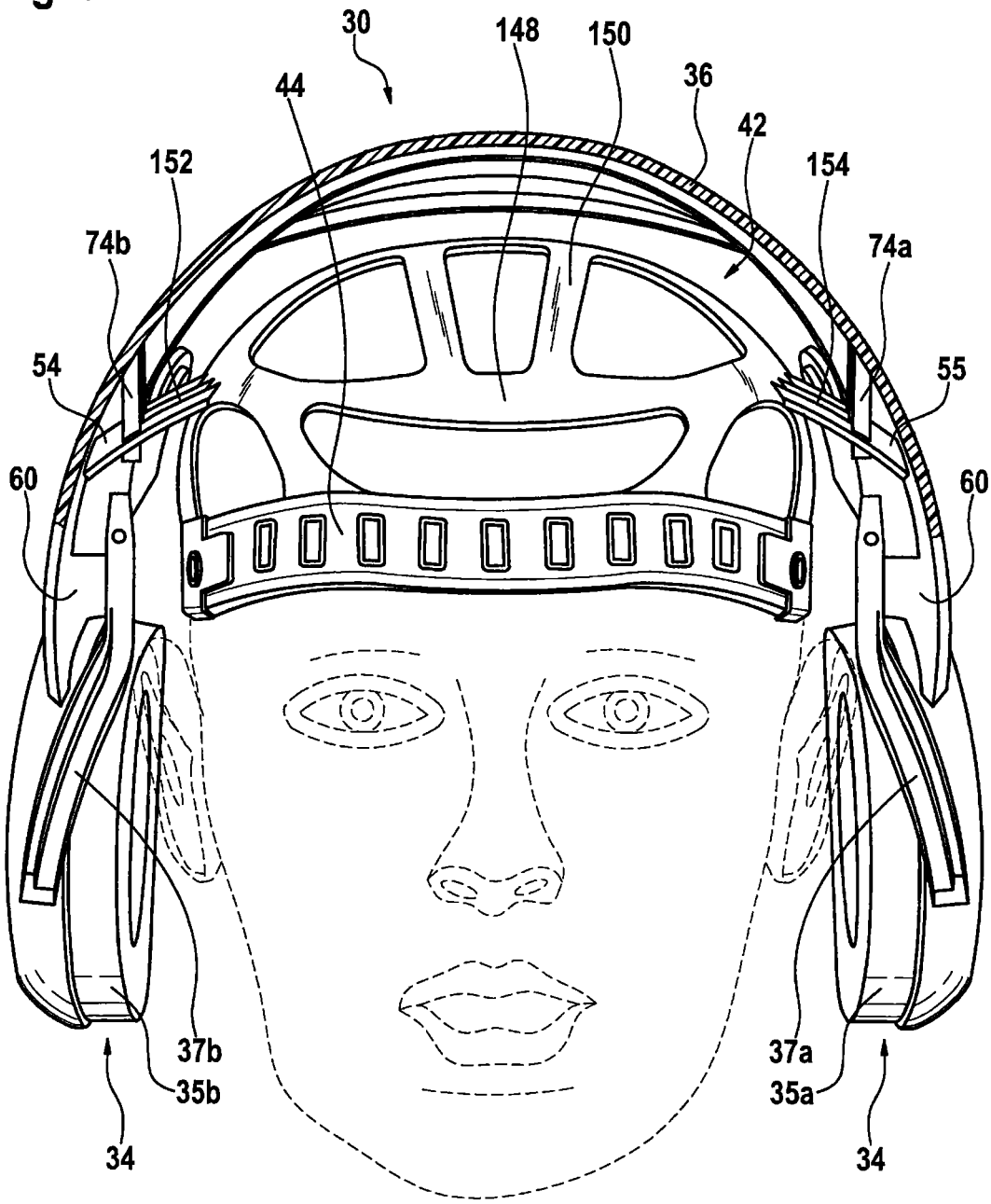
Figure 9:
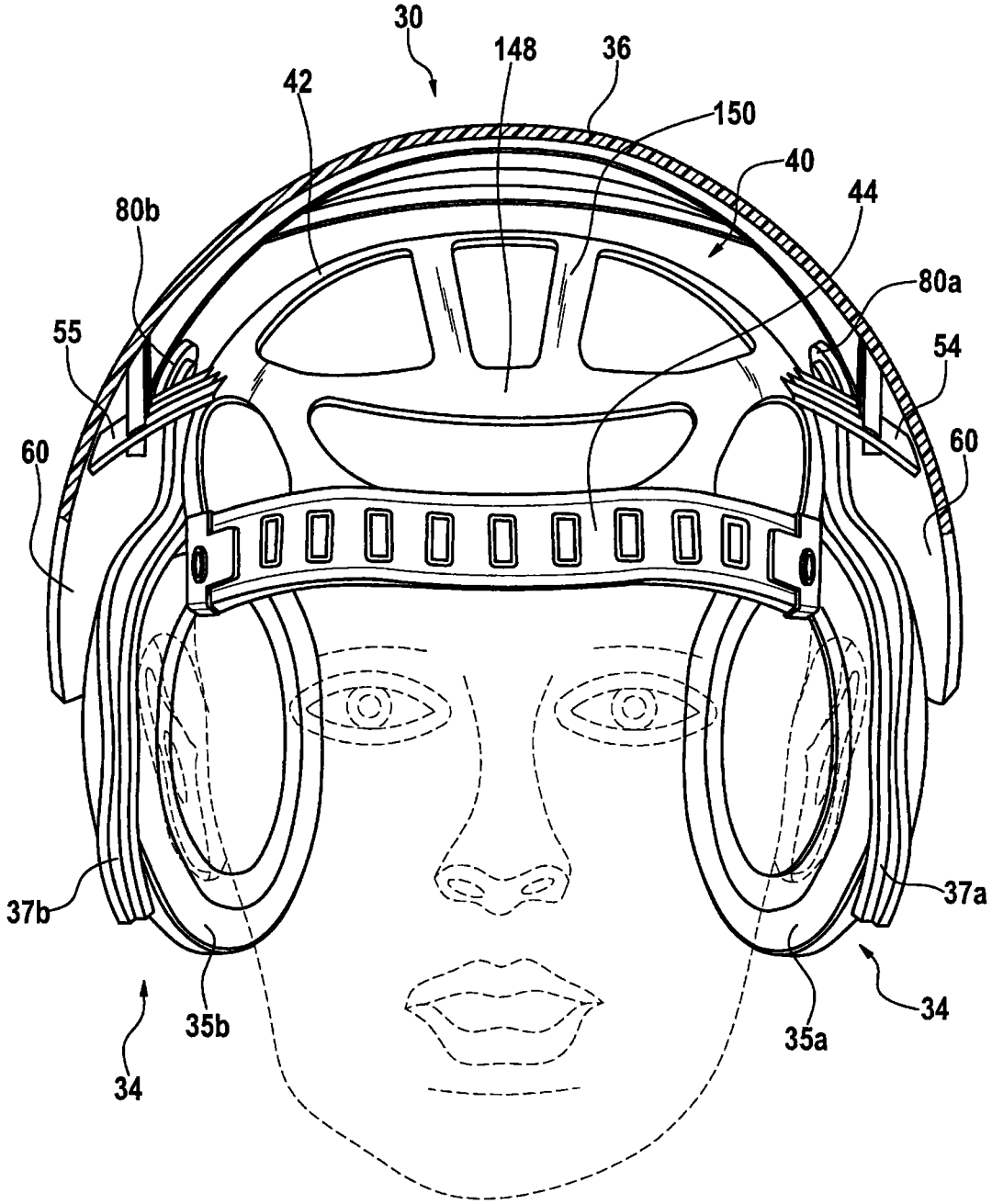
Figure 10:
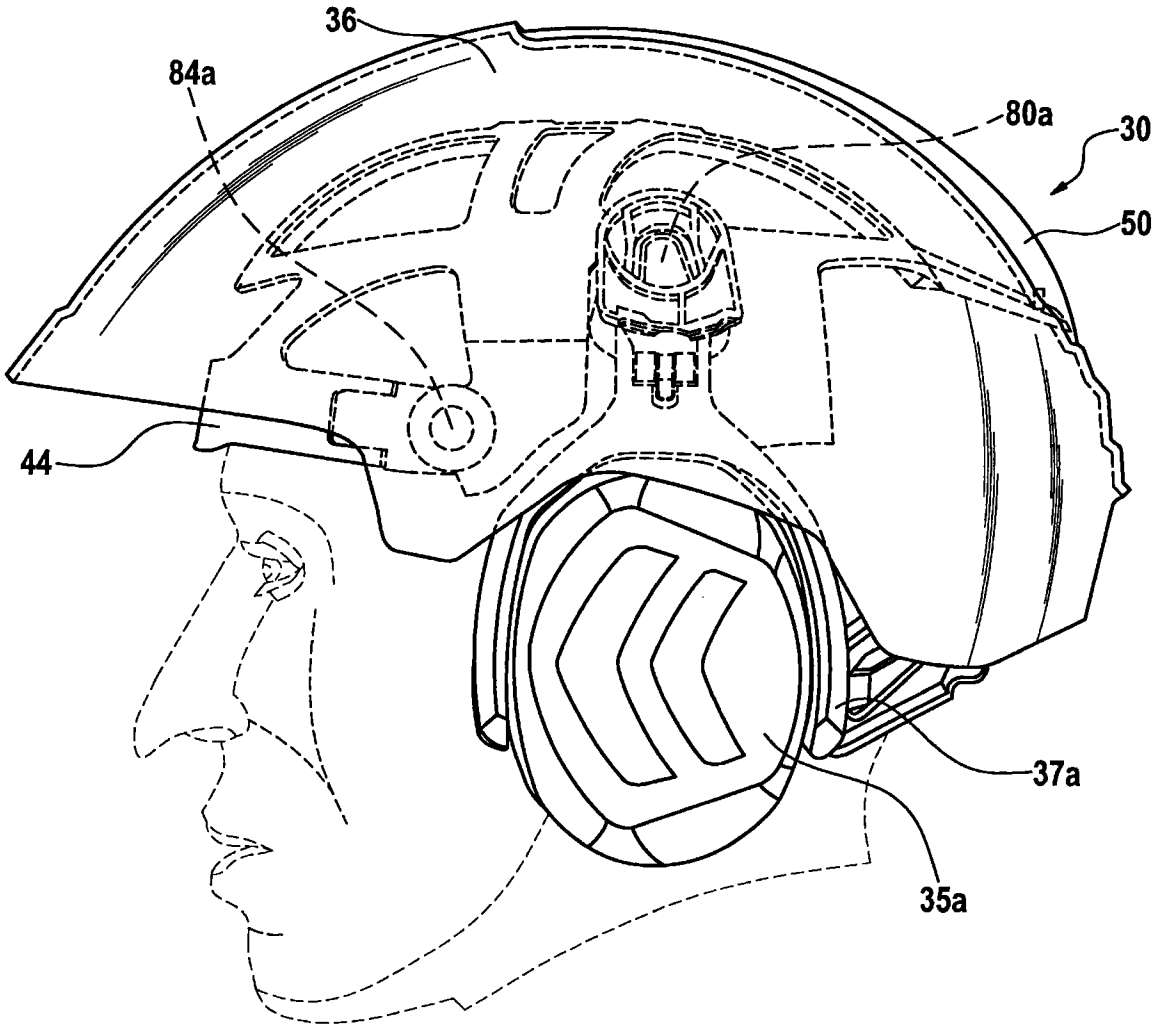
Figure 11:
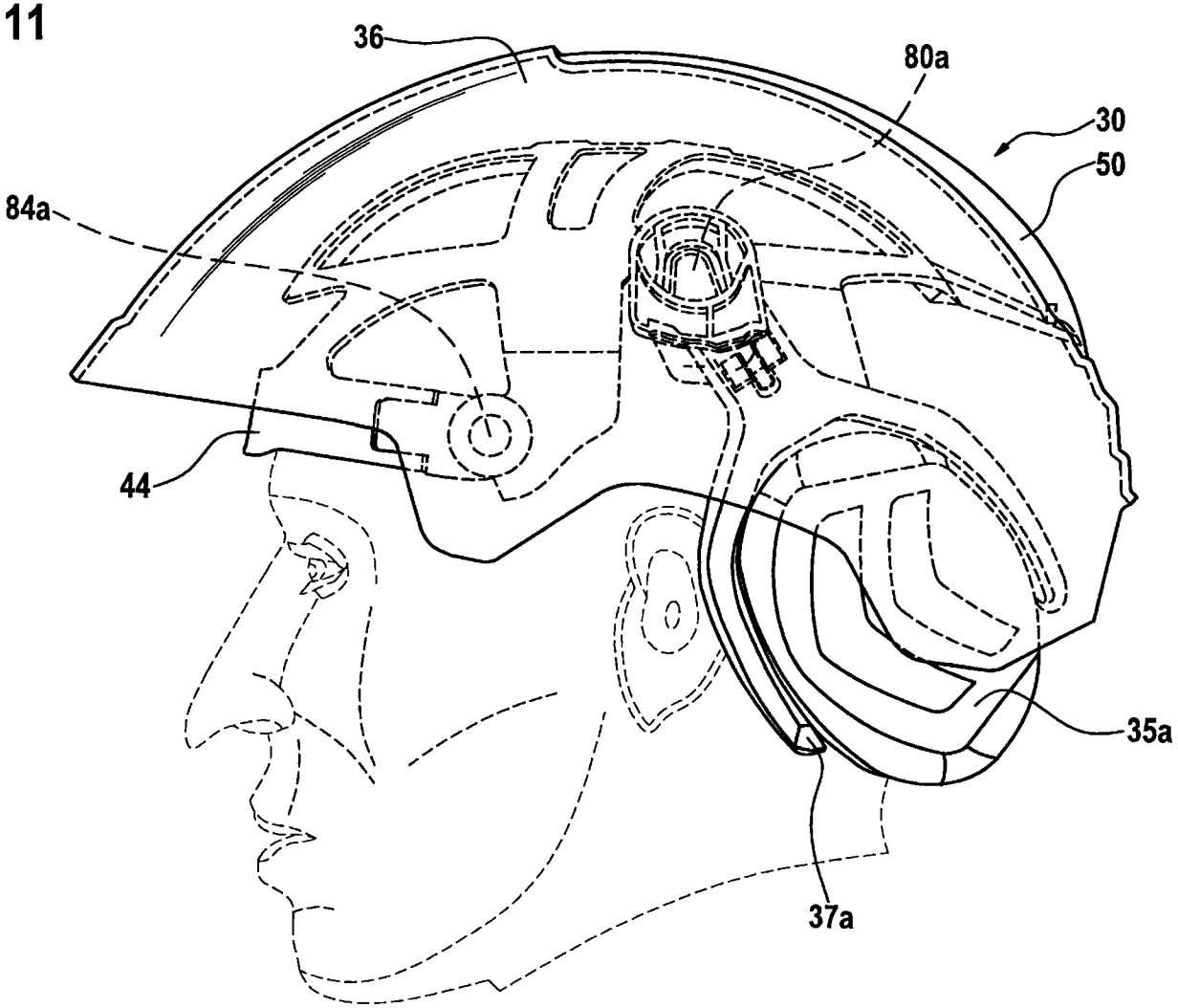
Figure 12:
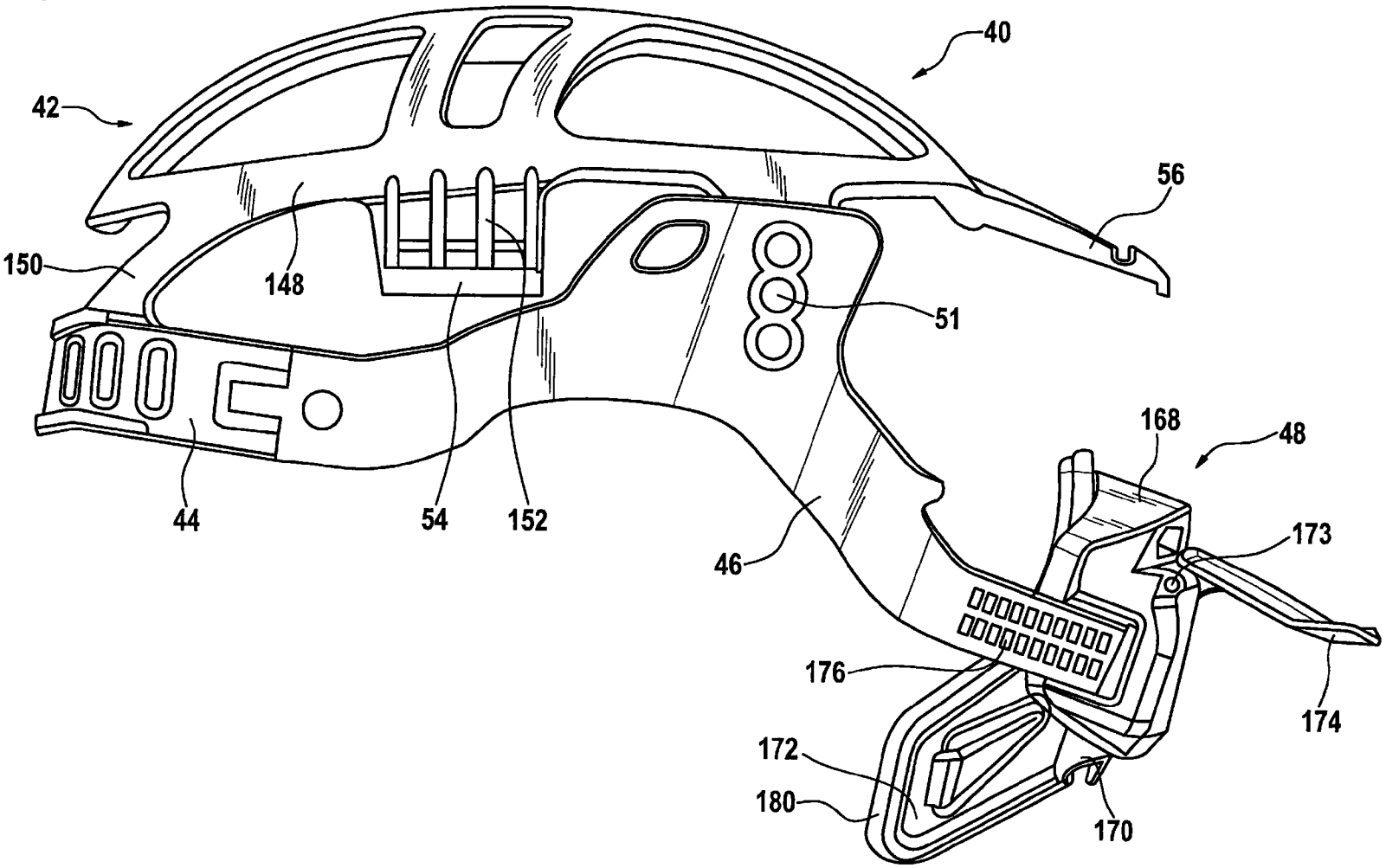
Figure 13:
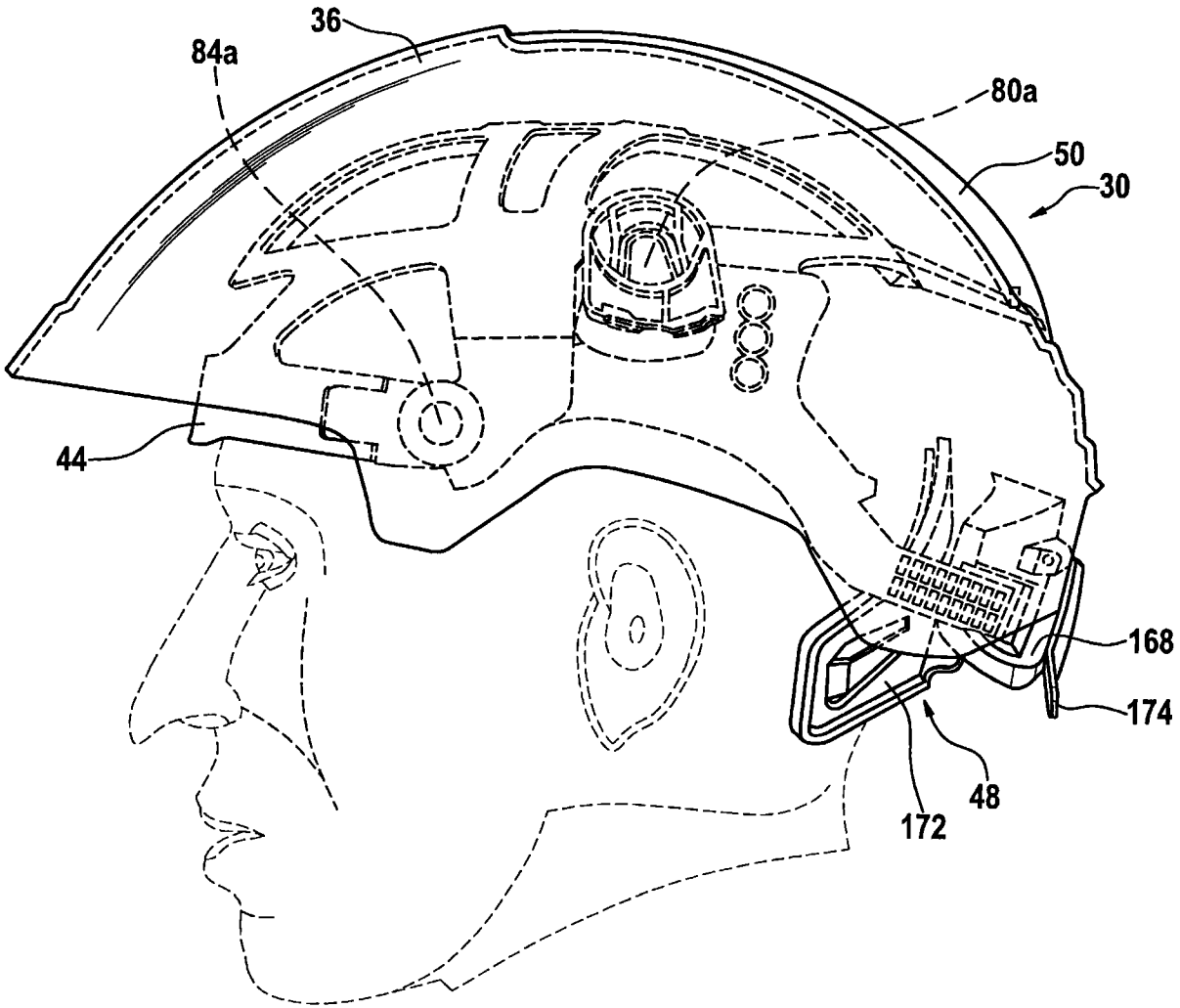
Figure 14:
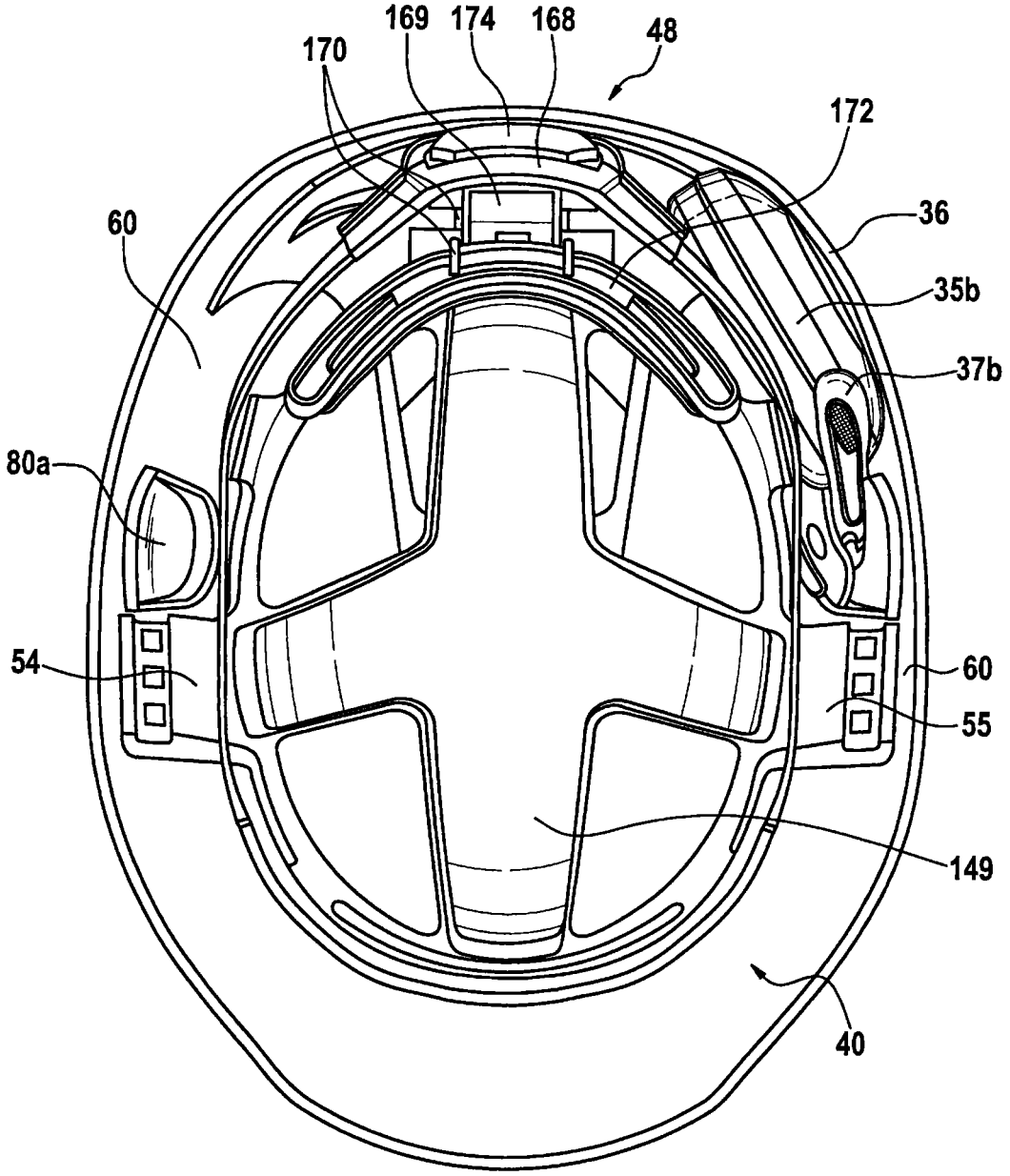
Figure 15:
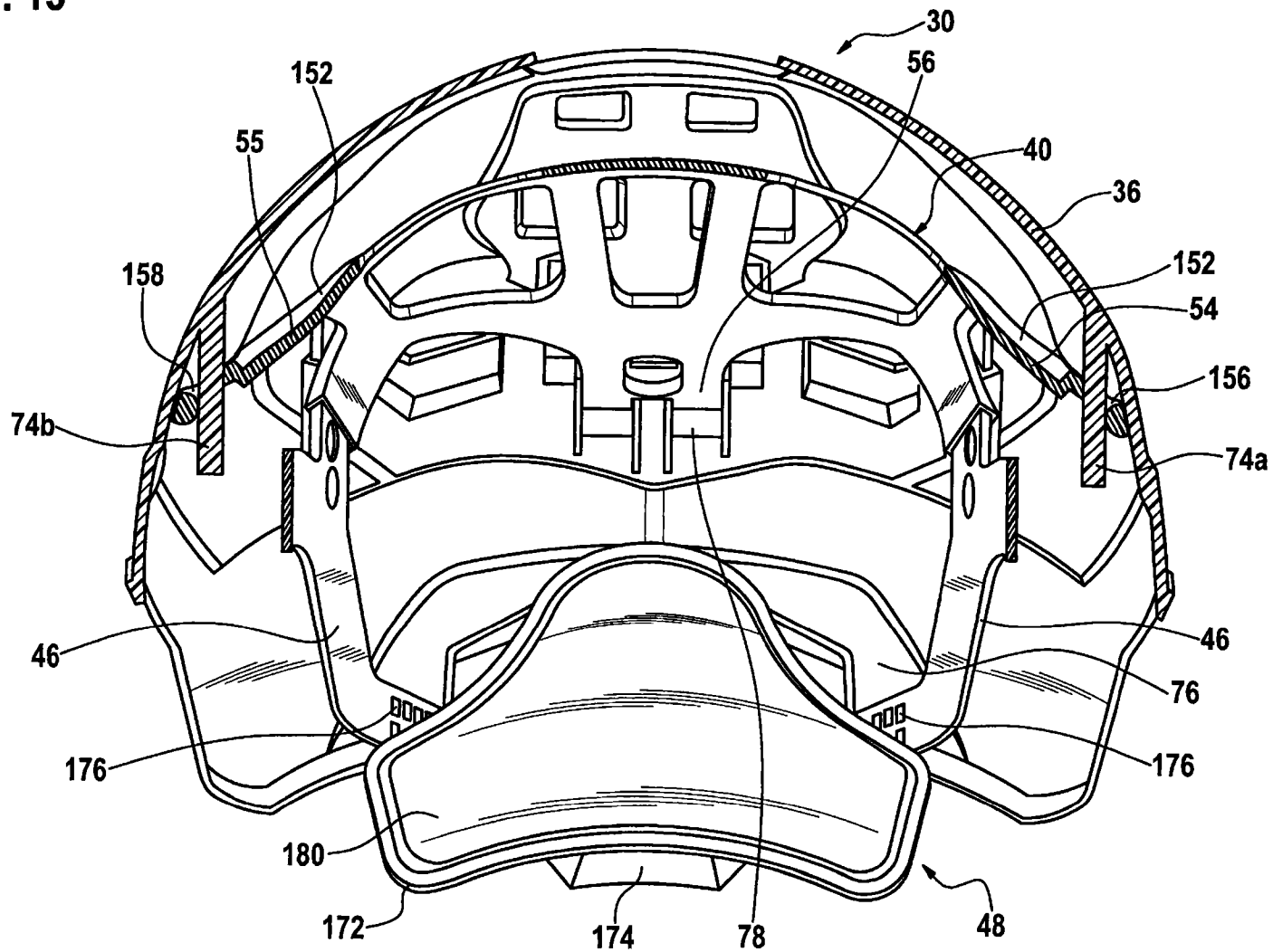
Figure 16:
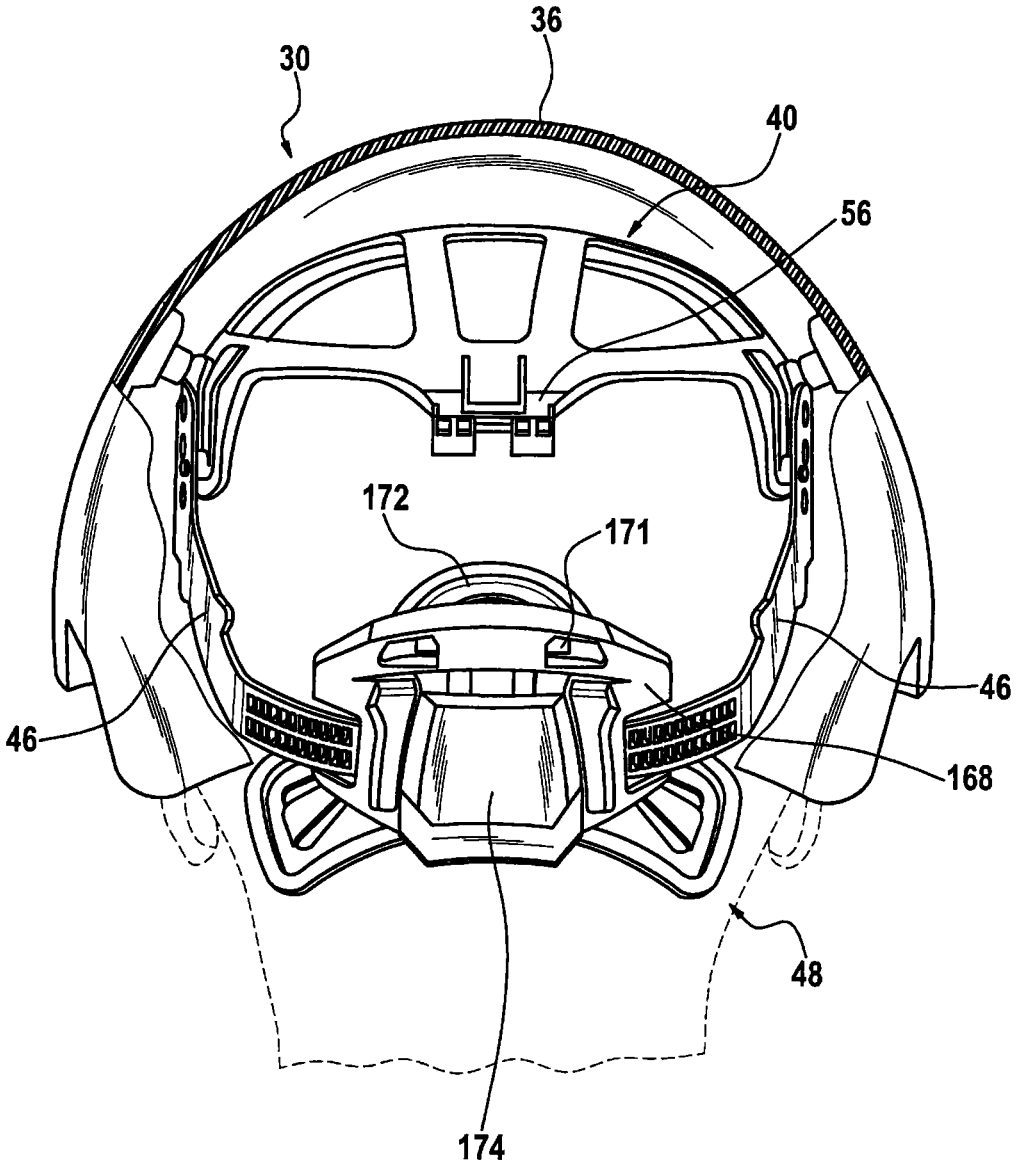
Figure 17:
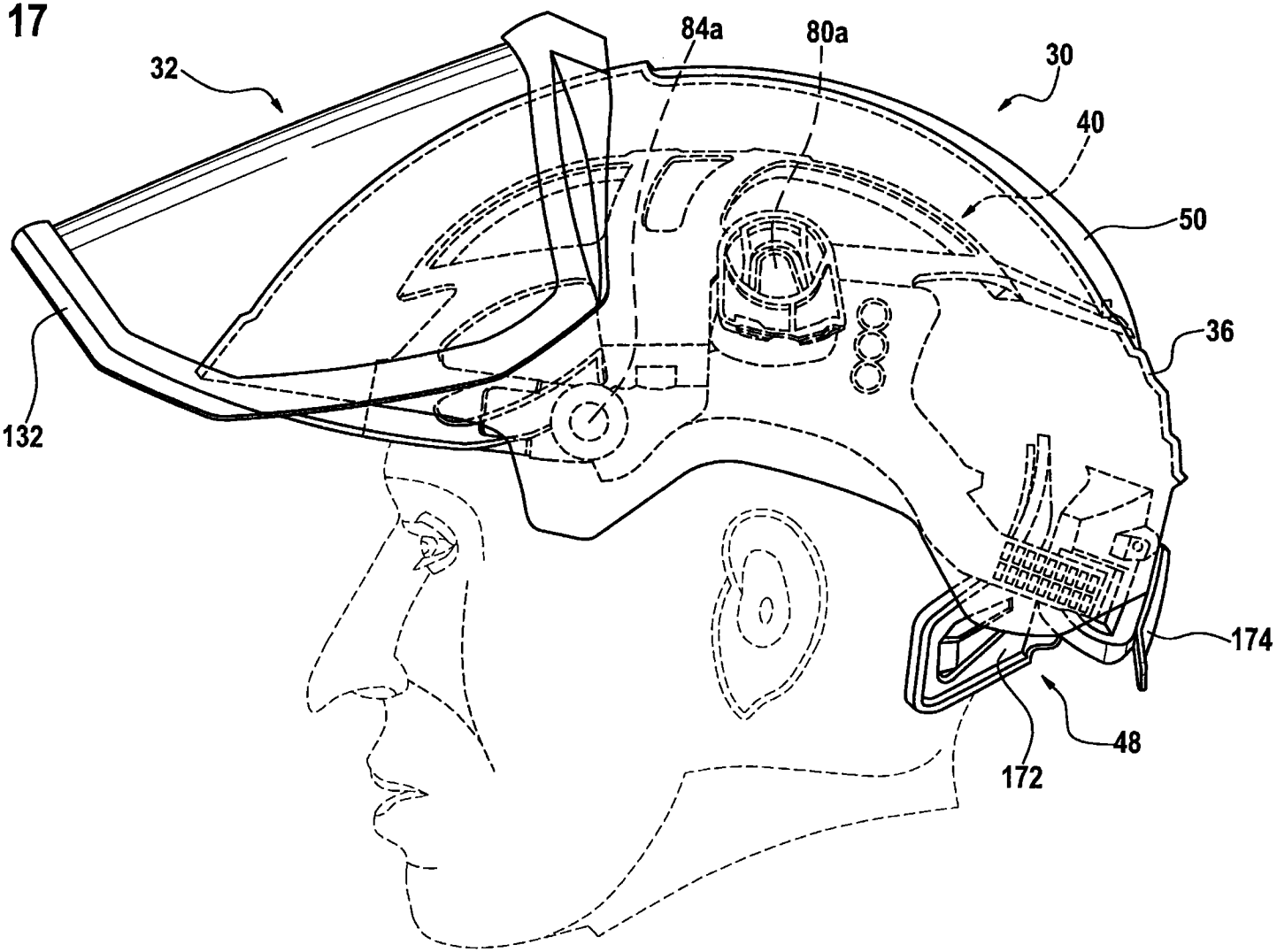
Figure 18:
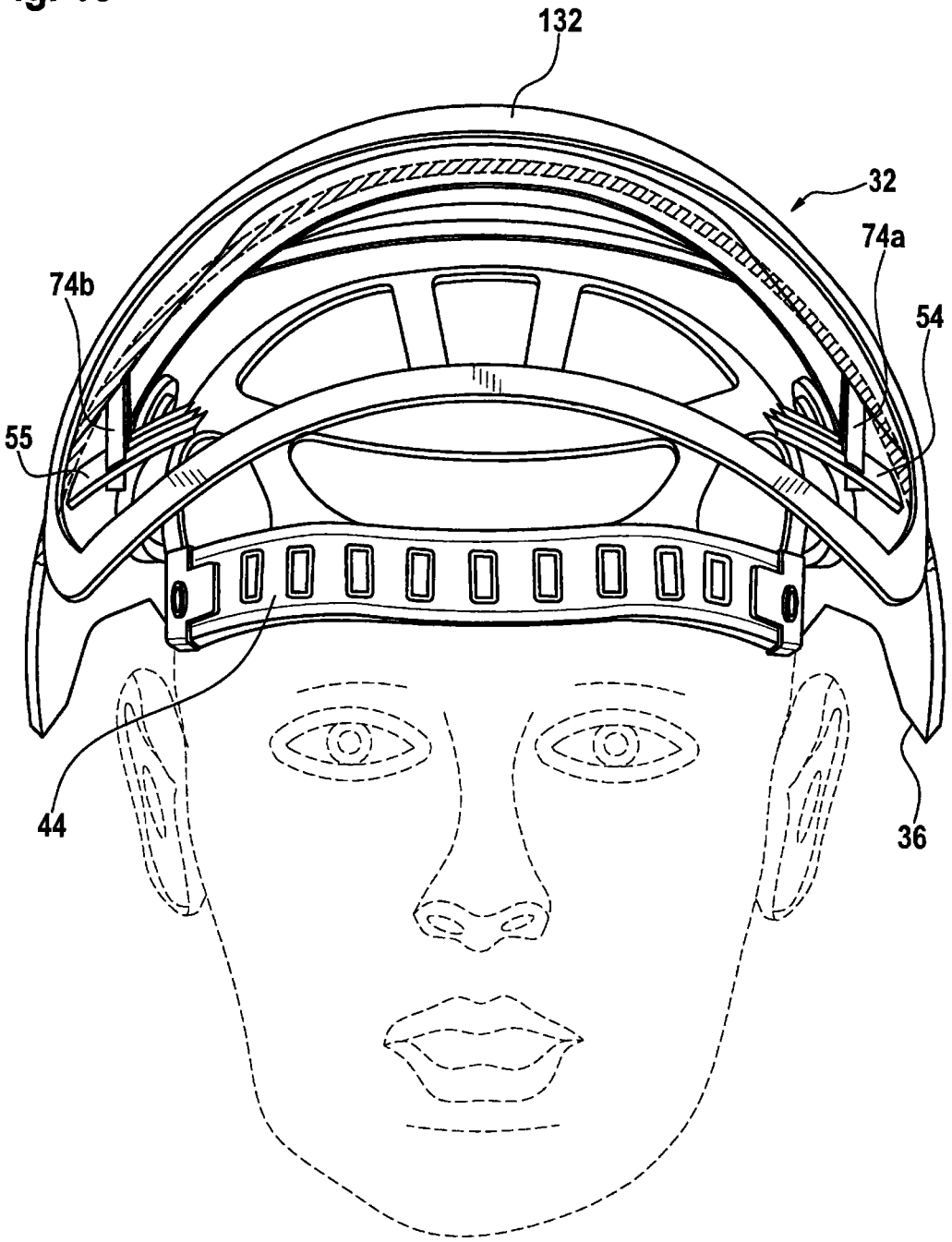
Figure 19:
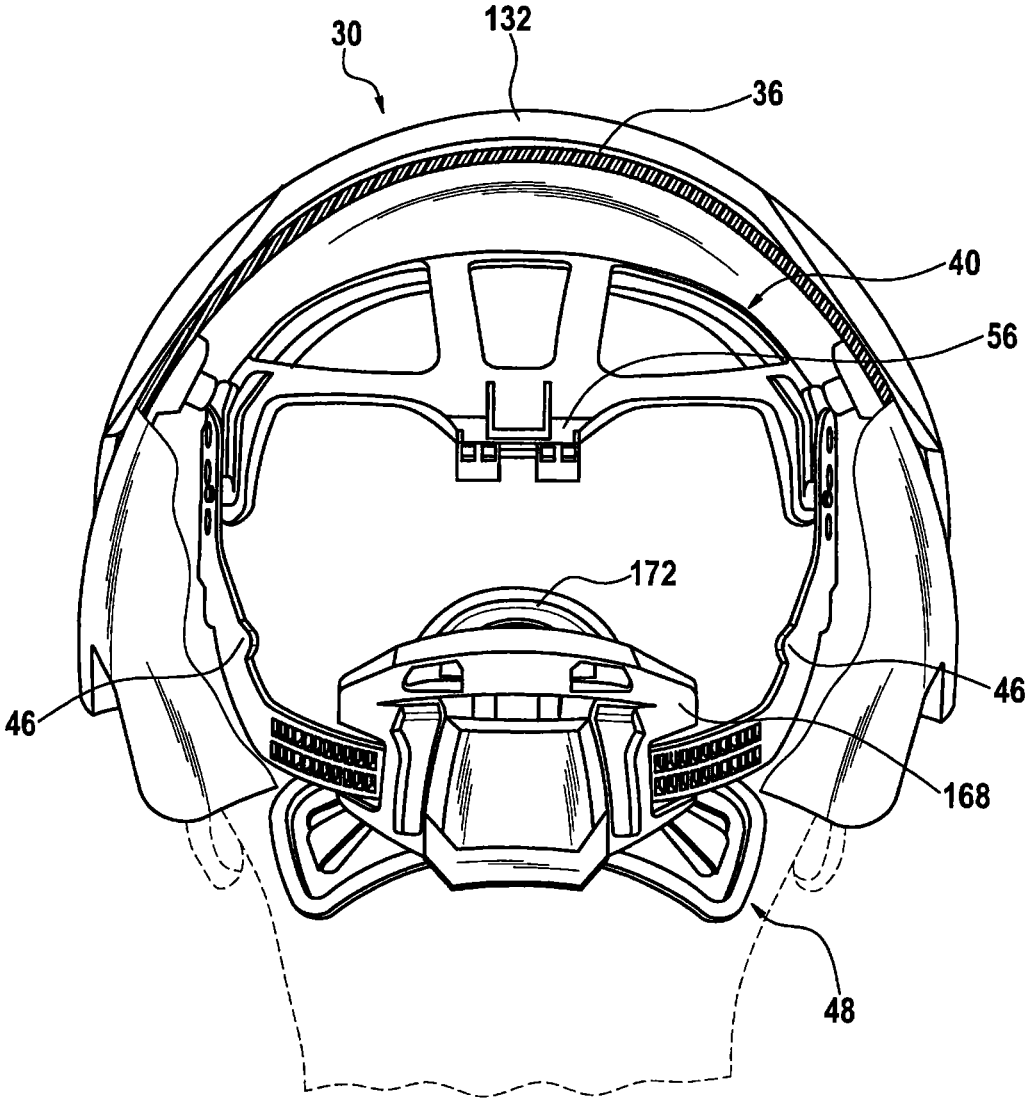
Figure 20:
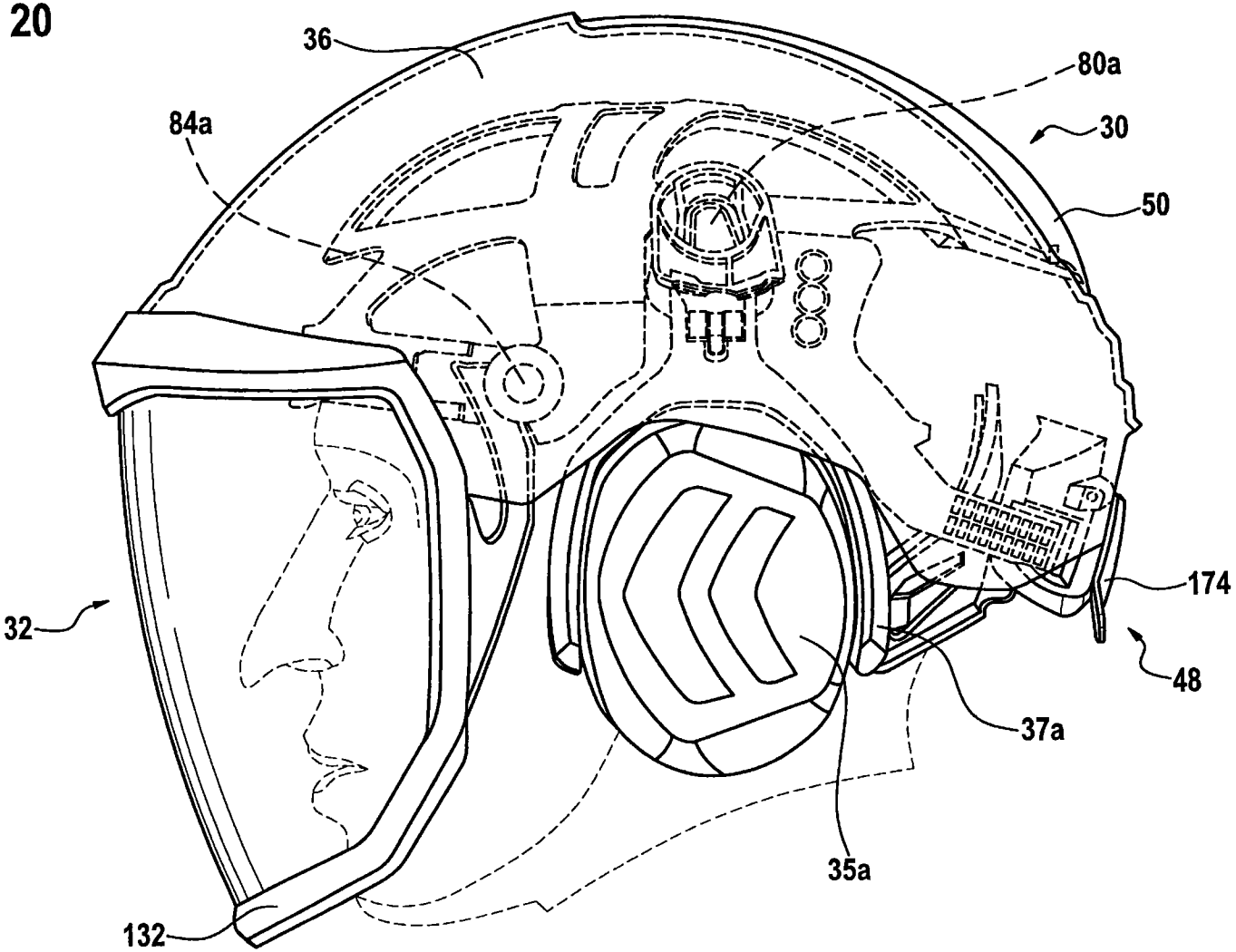
Figure 21:
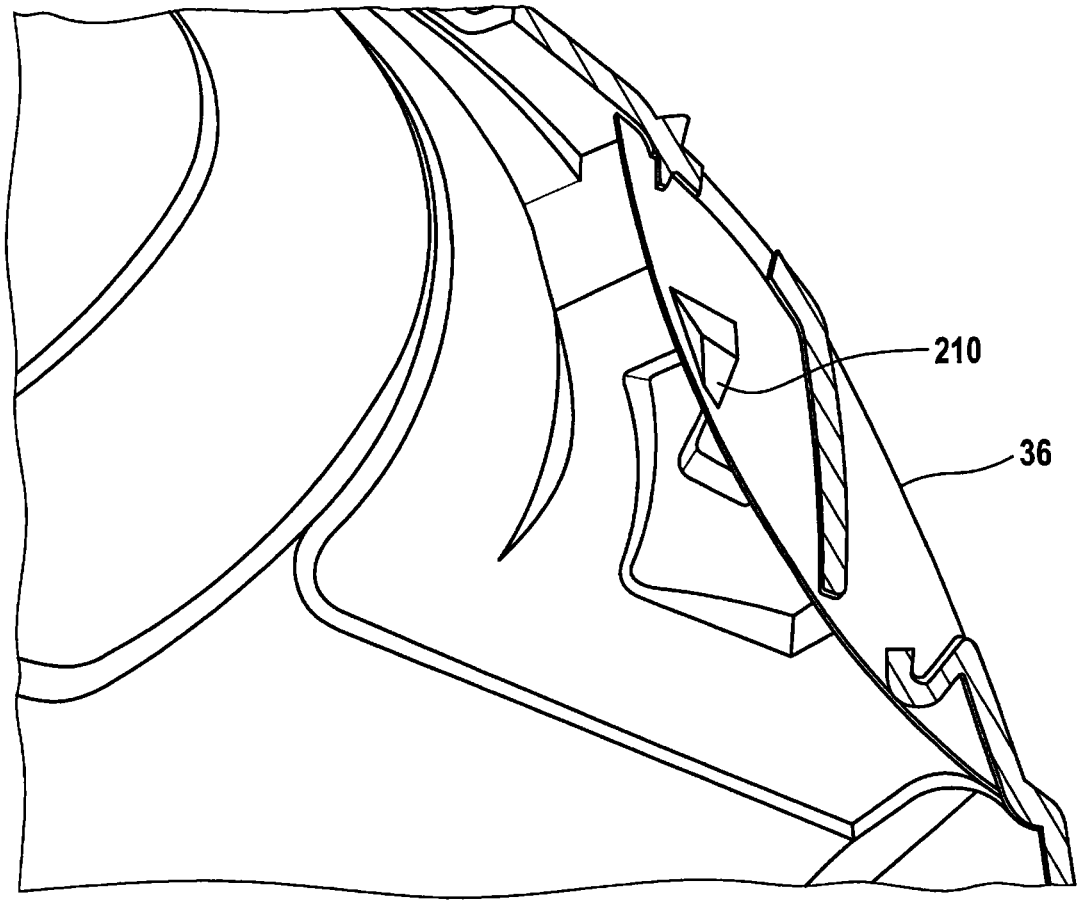
Figure 22:
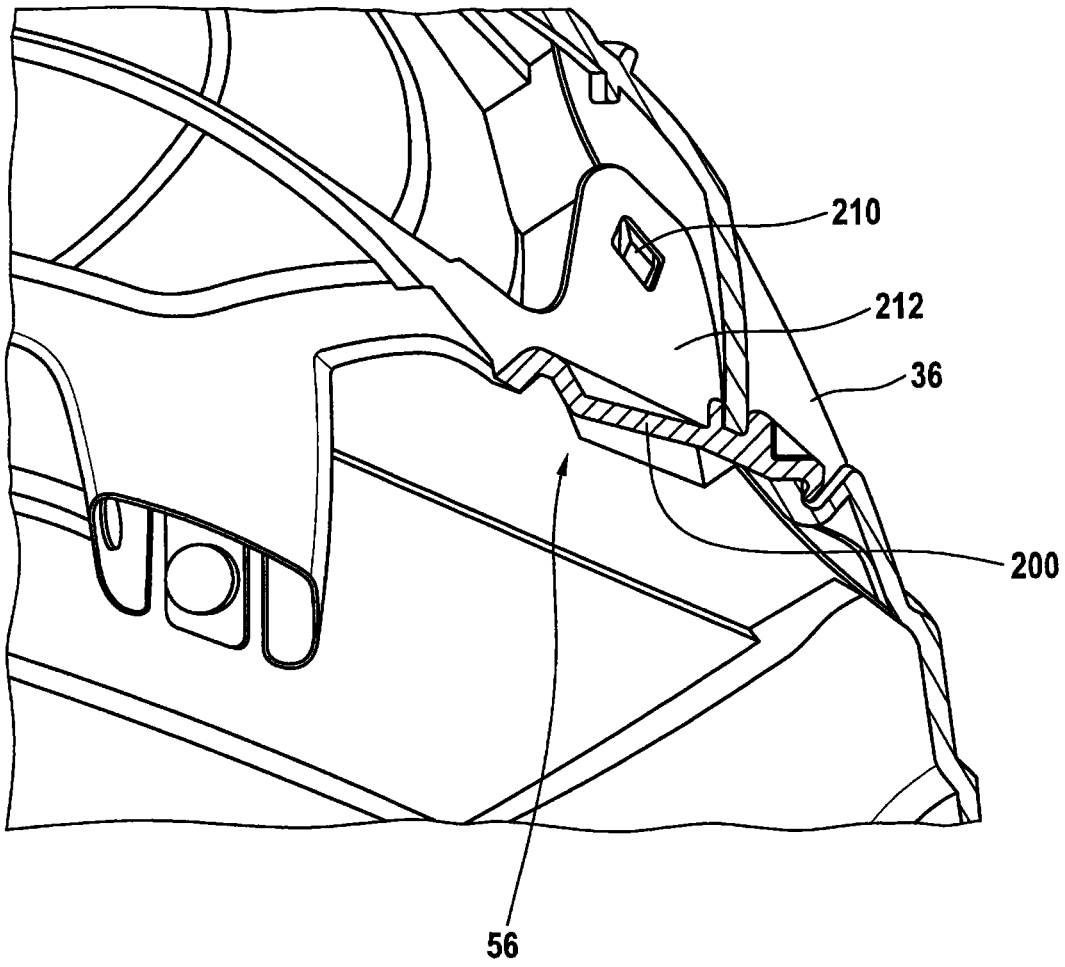
Figure 23:
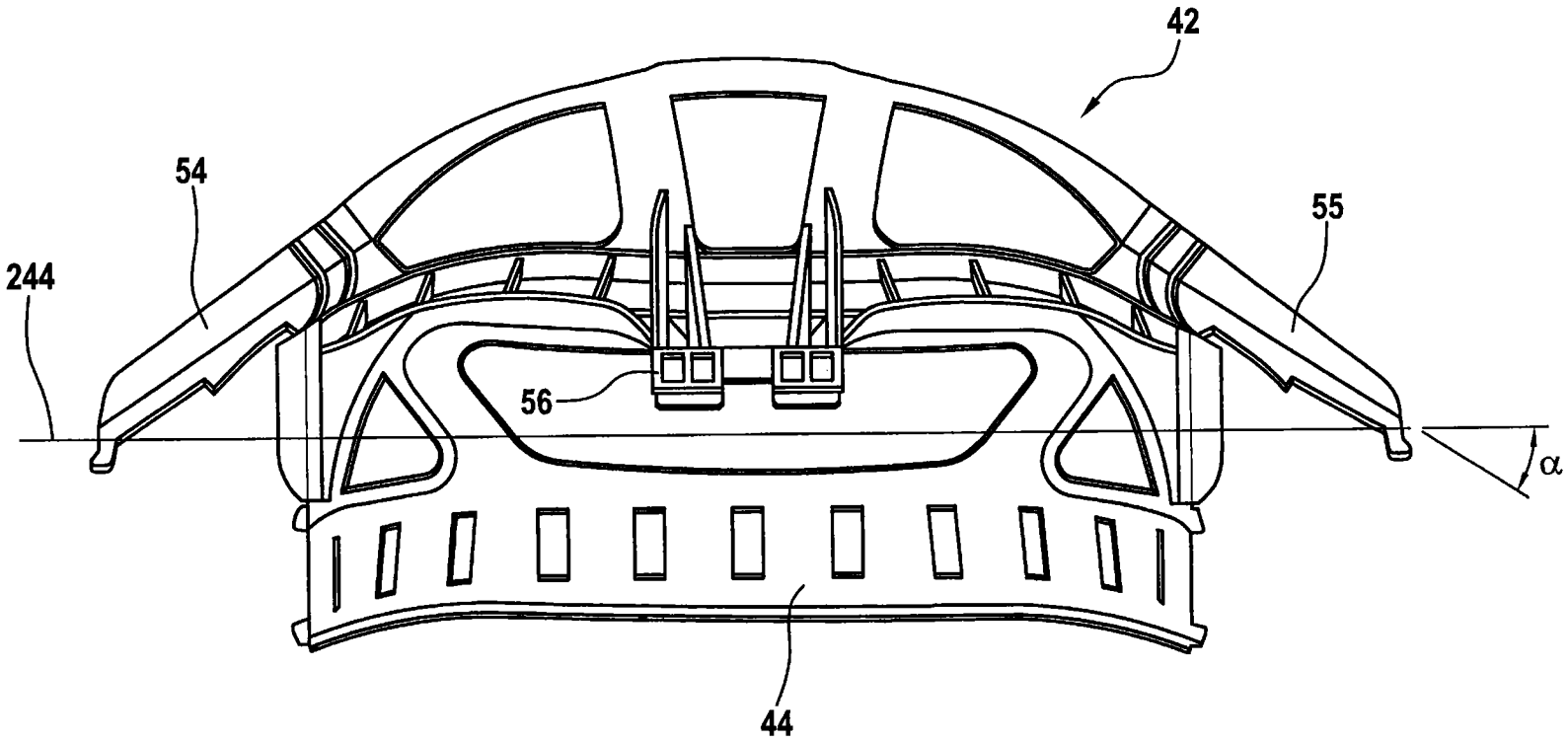
Figure 24:
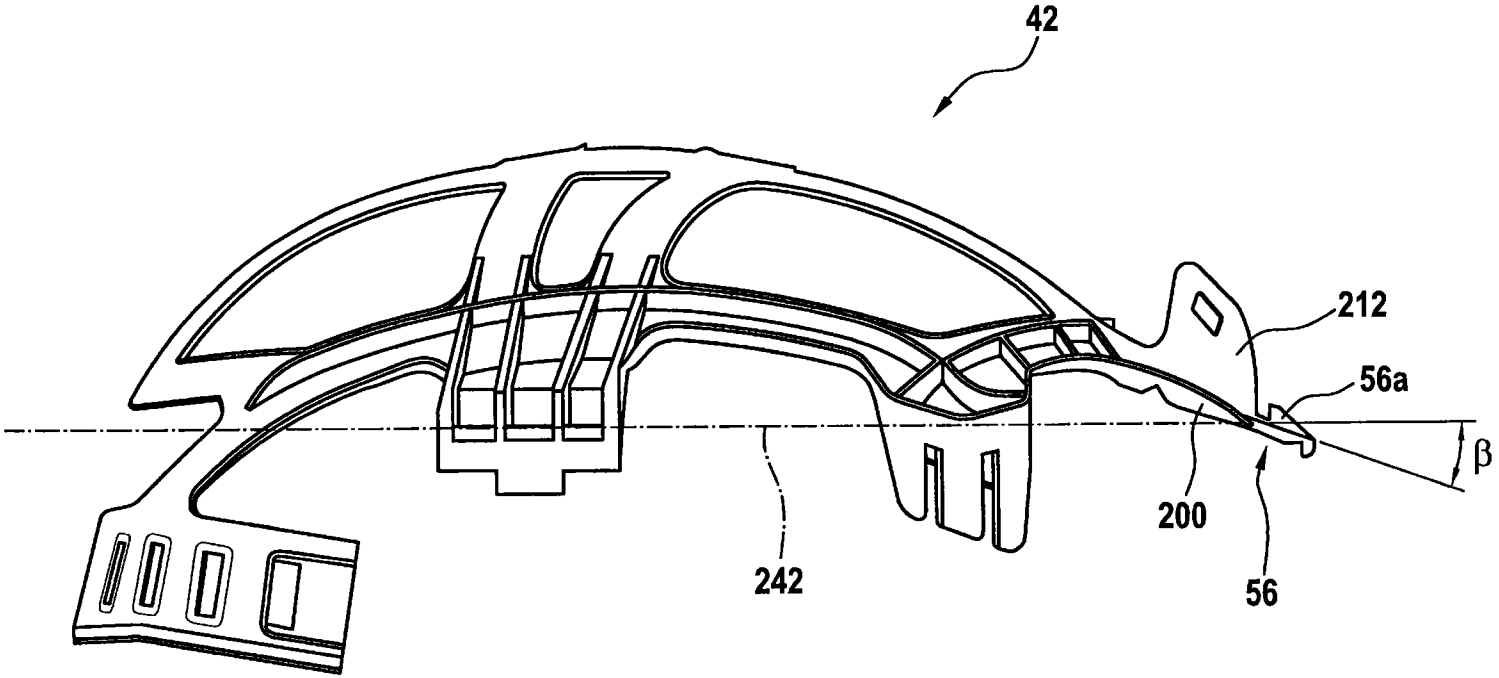
Figure 25:
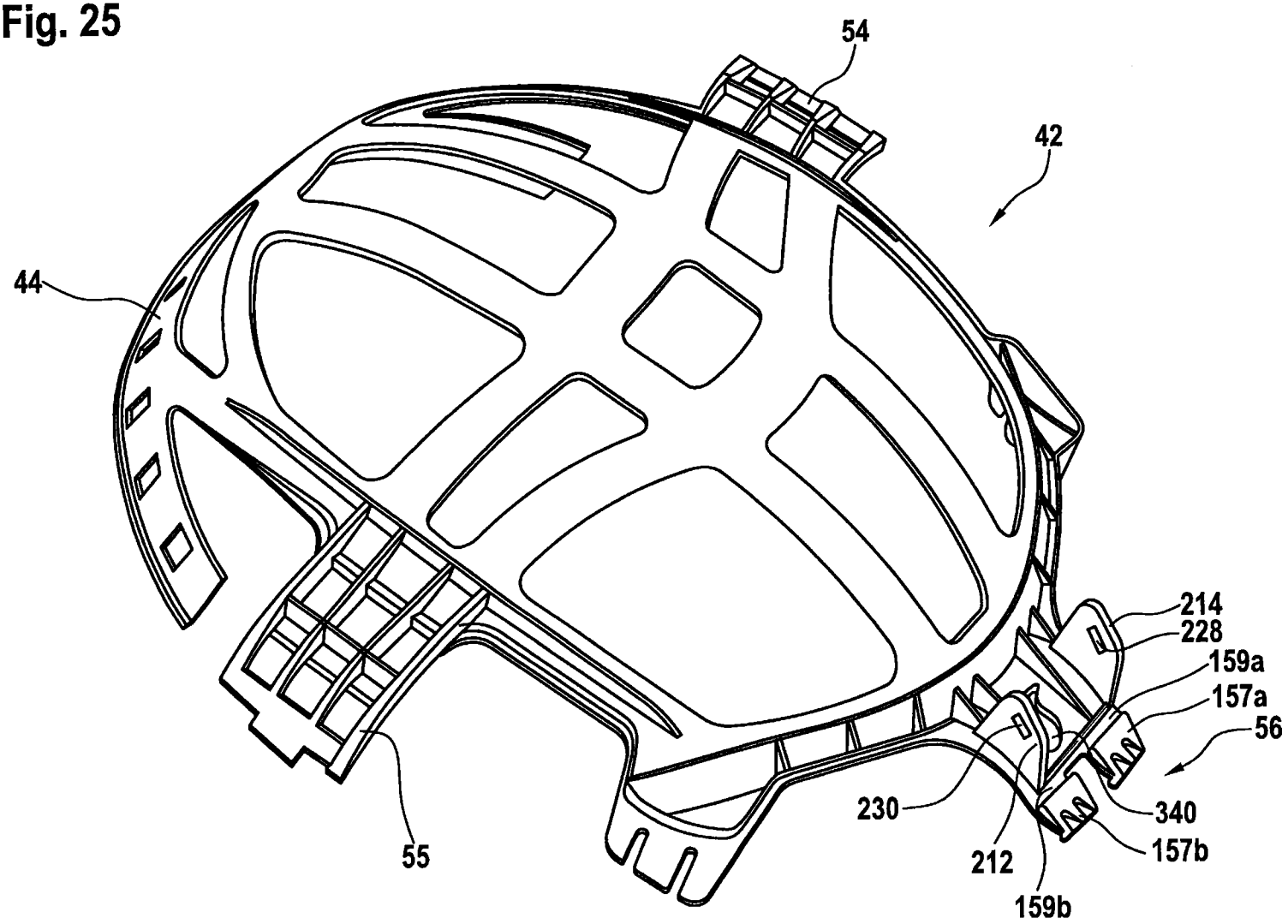
Figure 26:
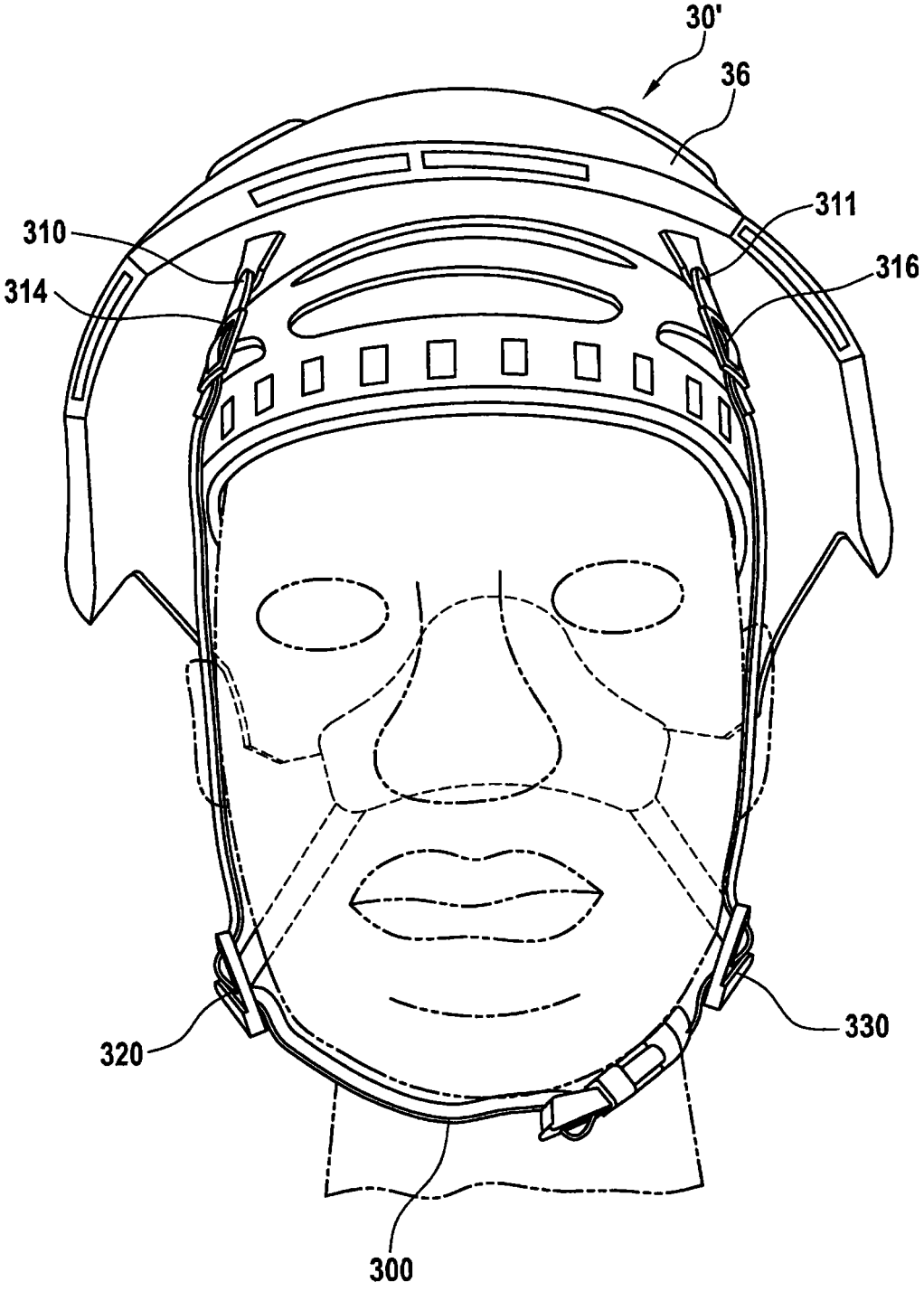
Figure 27:
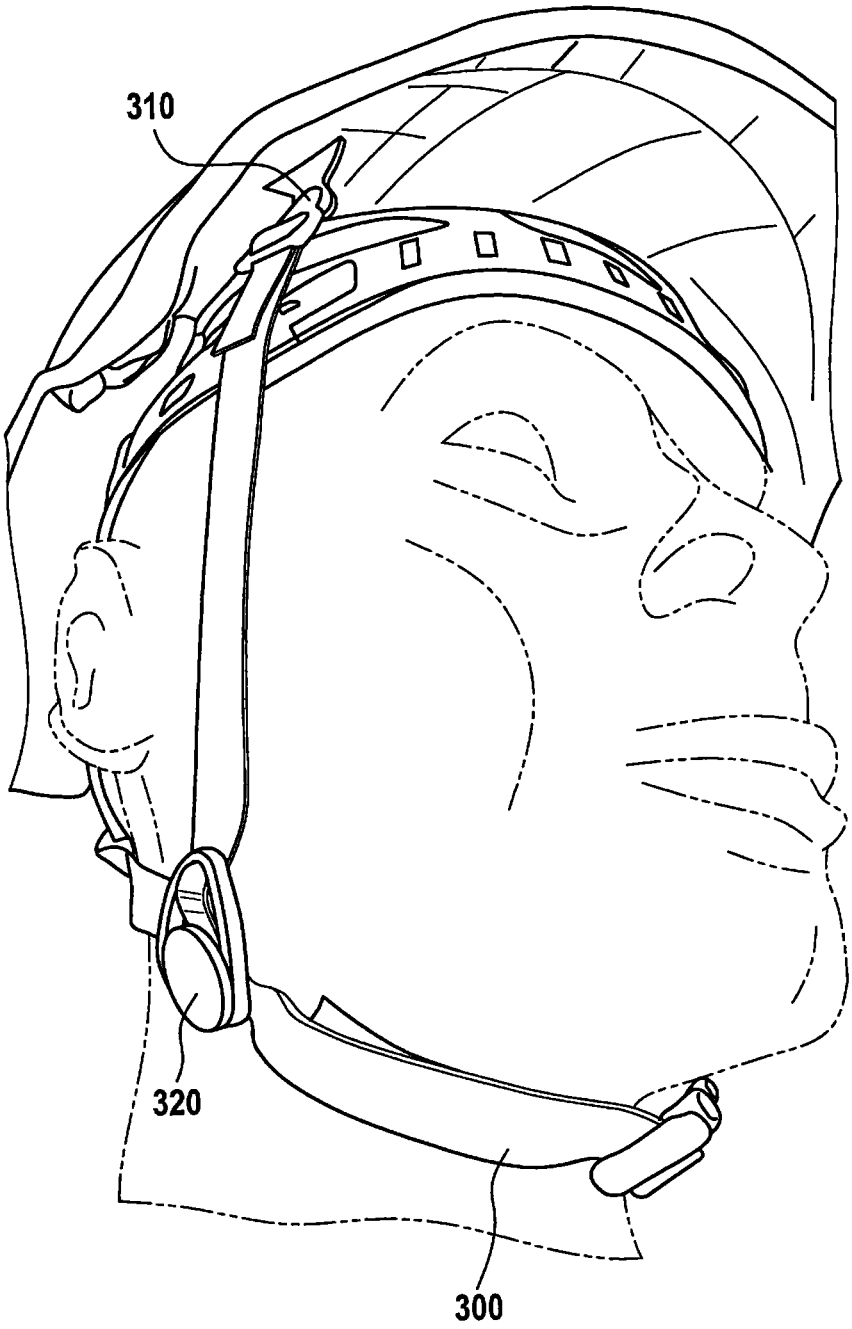
Figure 28:
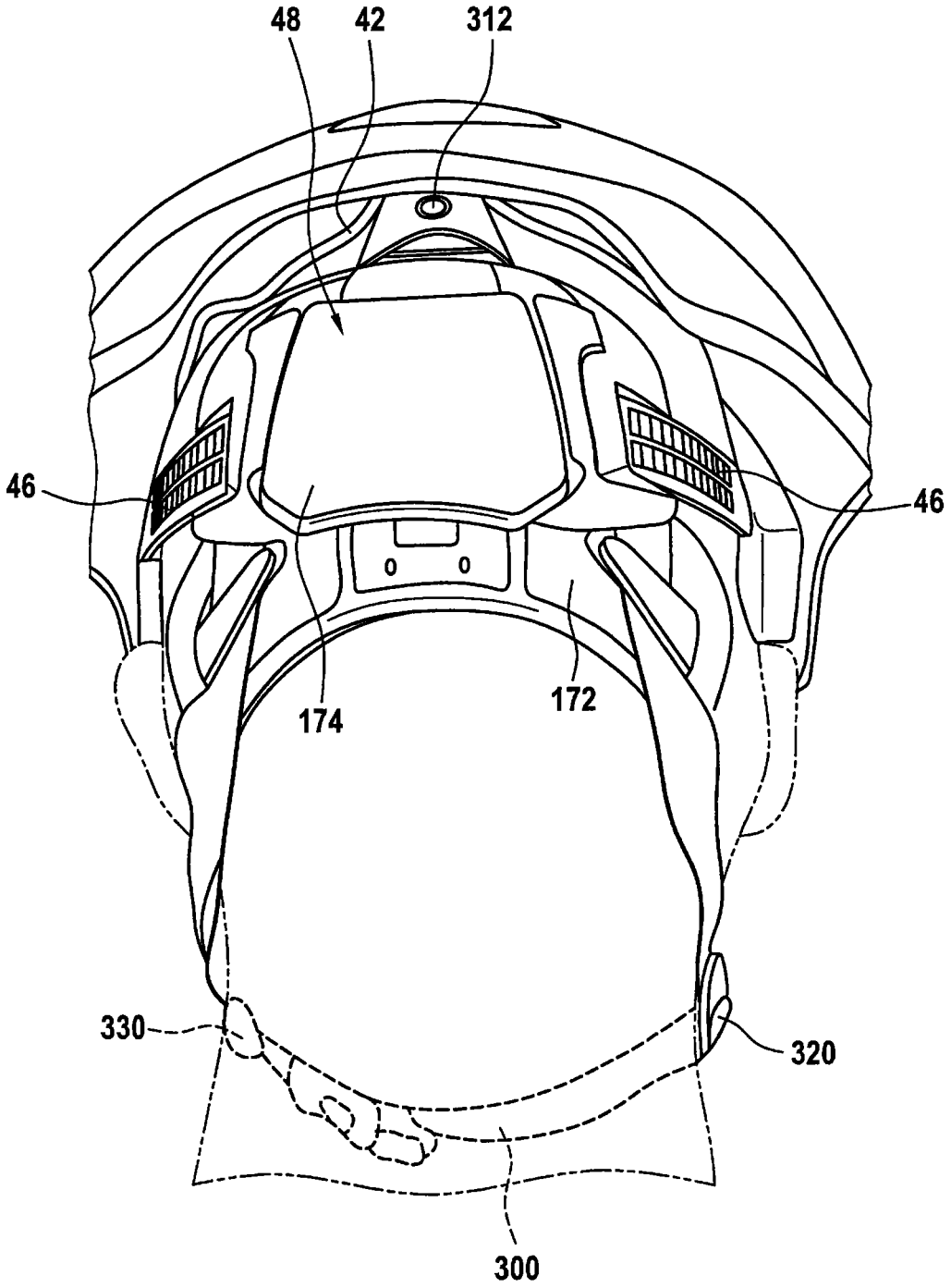
Figure 29:
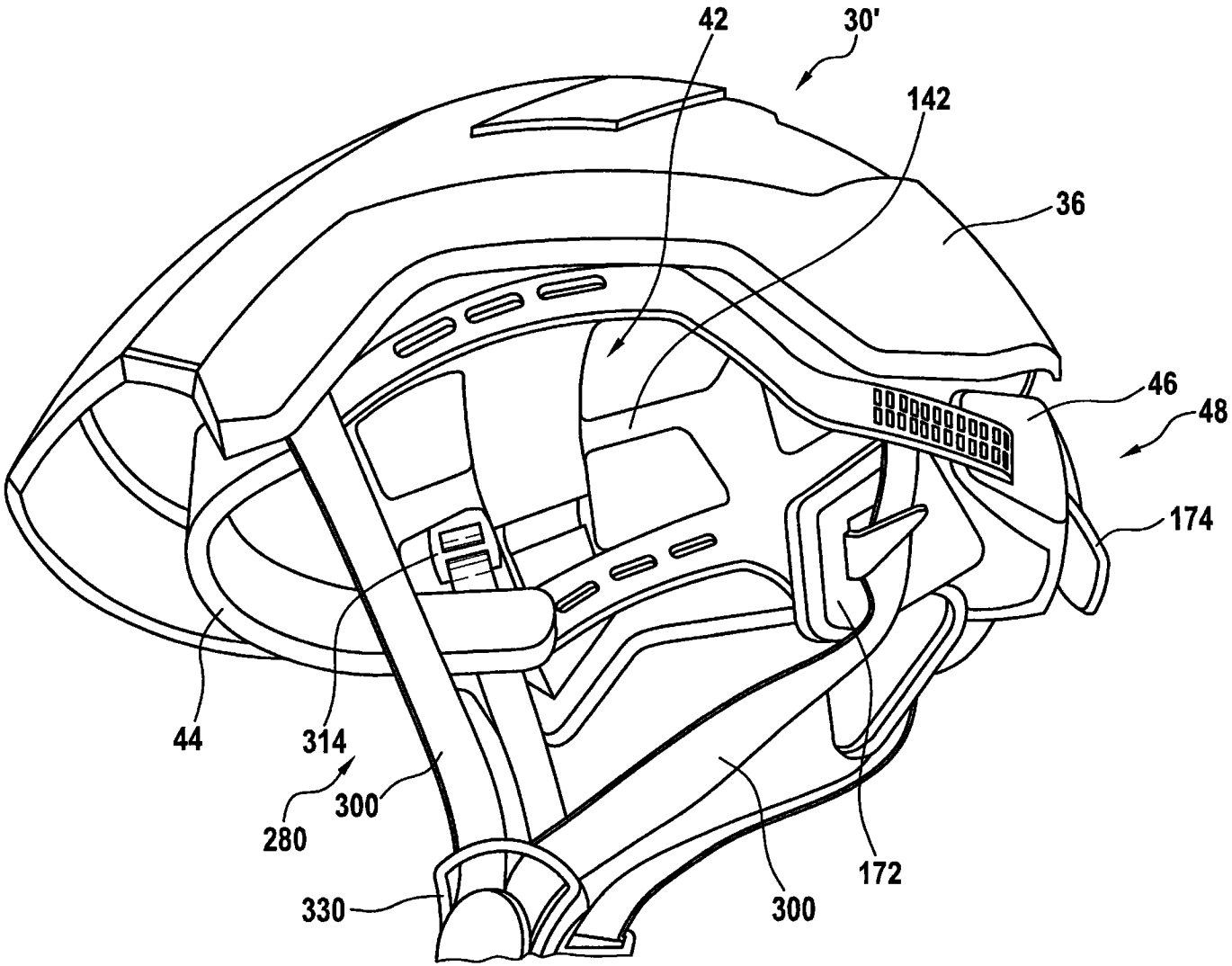
Figure 31:
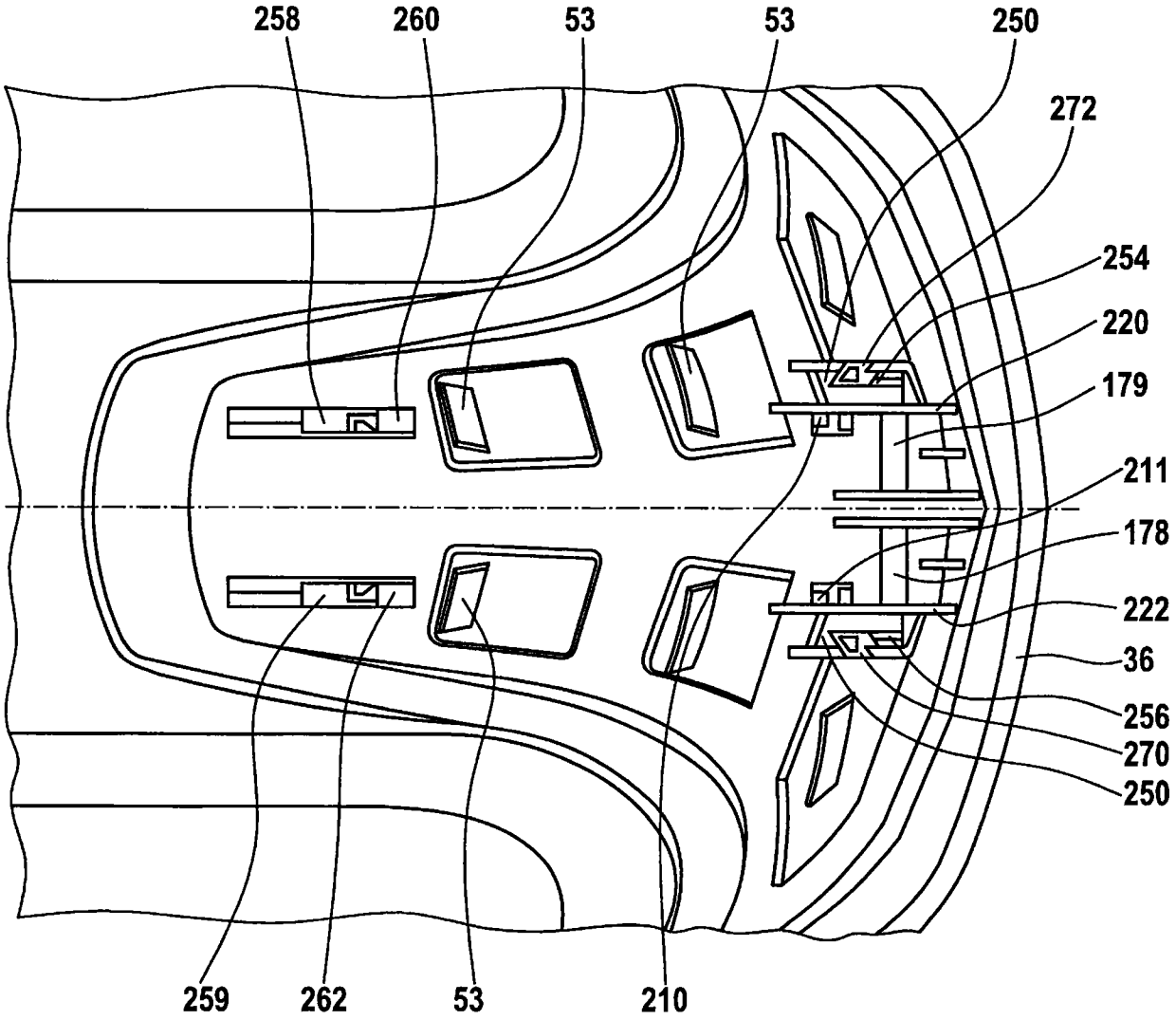
Figure 32:
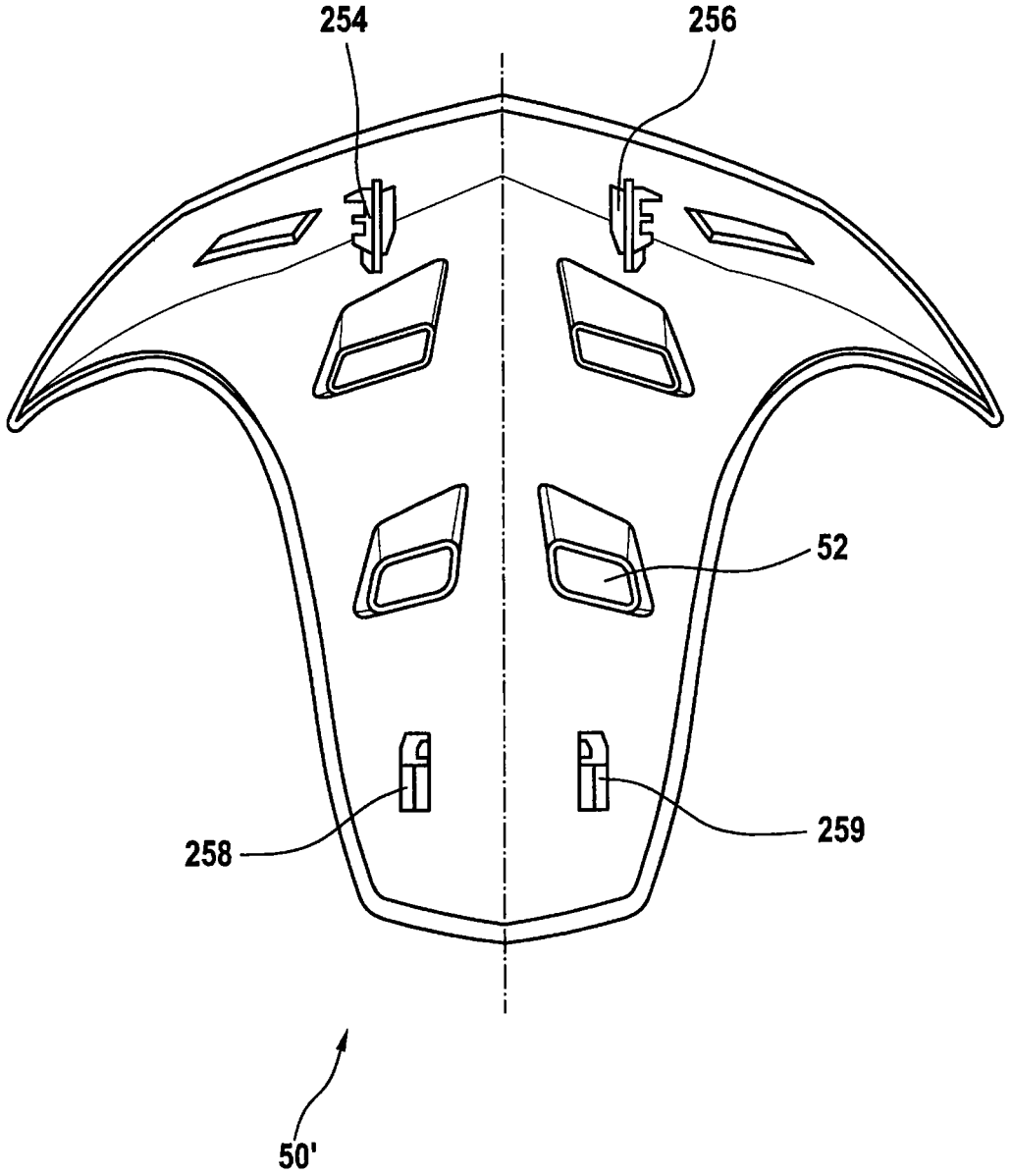
Figure 33:
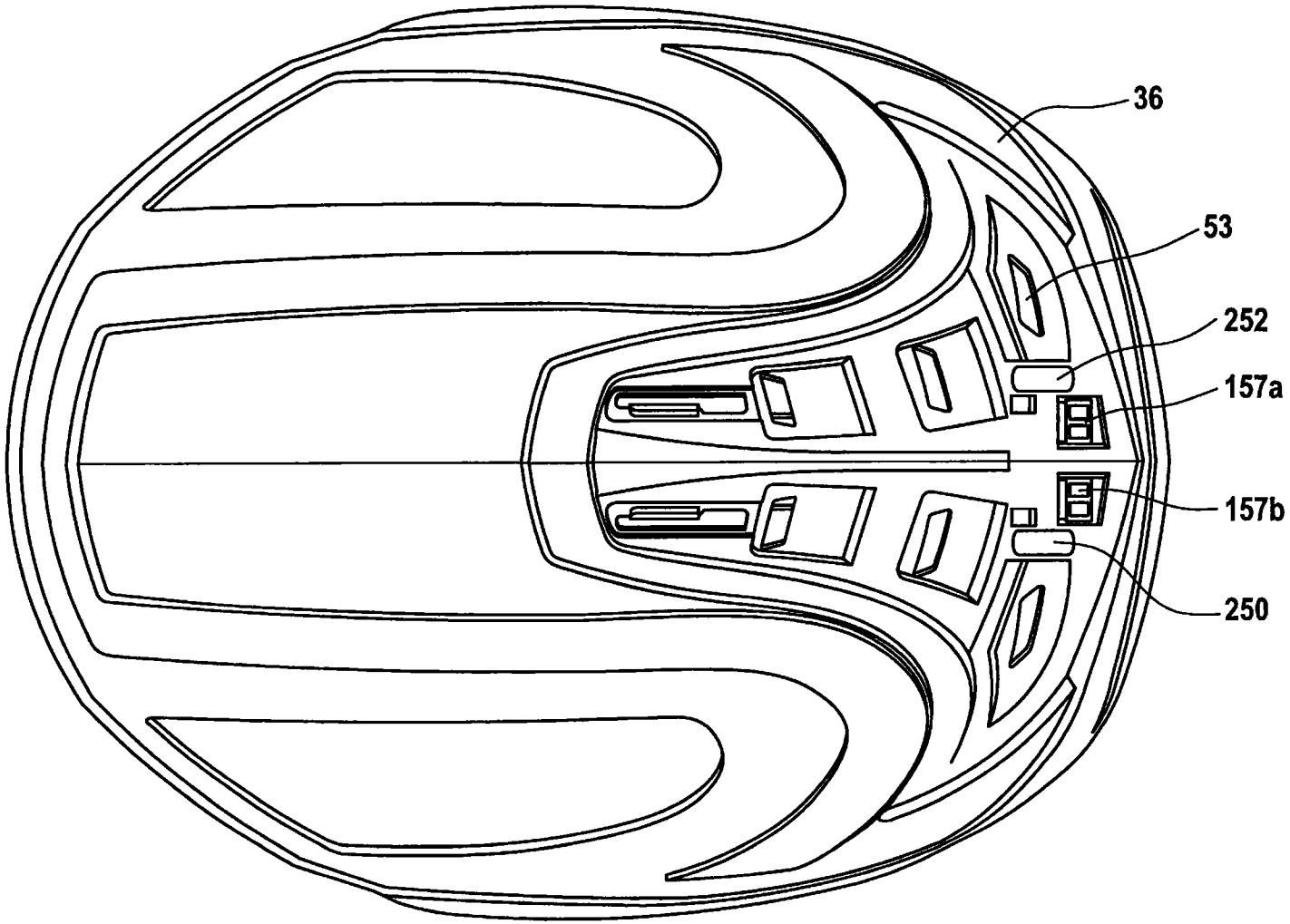
Figure 34:
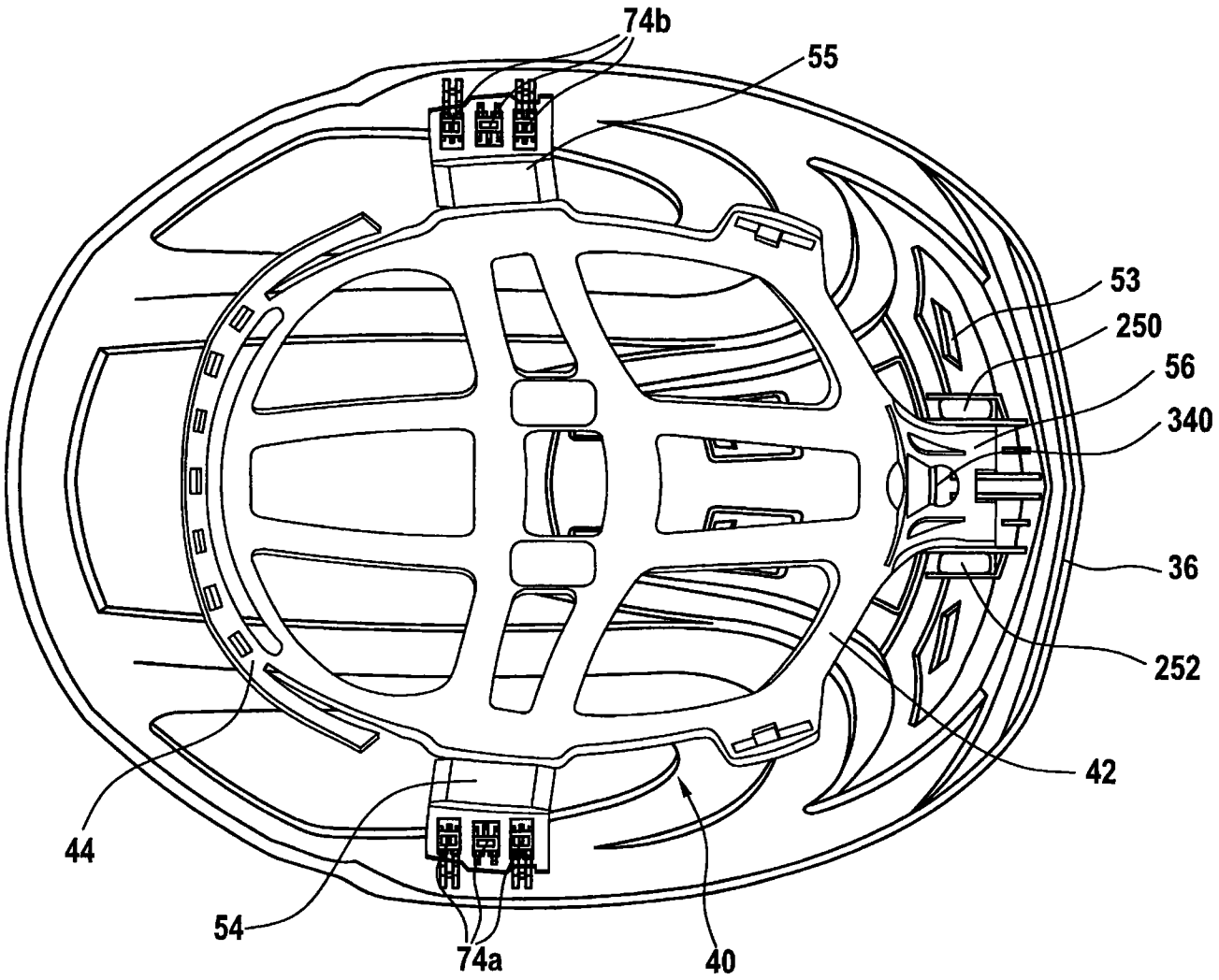
Figure 35:
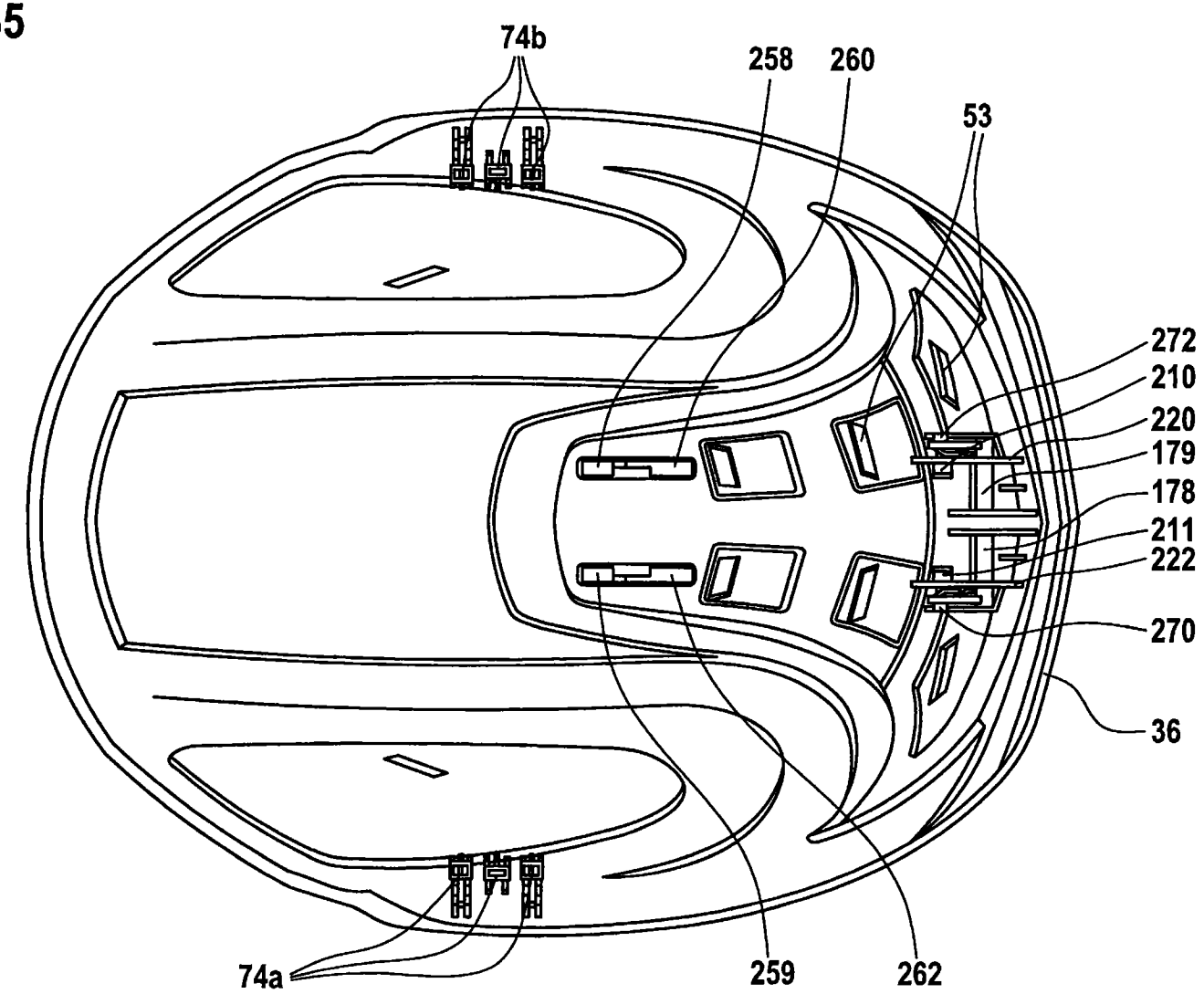

In the following, embodiments of the invention will be described in more detail with reference to the drawings in which:

FIG. 1 shows a perspective representation and an inclined view from below of an interior fitting subassembly of a protective helmet according to the prior suggestion of the applicant, FIG. 2 shows the interior fitting subassembly according to FIG. 1 in an inclined view from above, FIG. 3 shows a longitudinal sectional view of the interior fitting subassembly according to FIG. 1 mounted in a helmet shell of the protective helmet according to the applicant's prior suggestion also shown in a longitudinal section, FIG. 4 shows the helmet shell according to FIG. 3 without the interior fitting subassembly in a view from below, FIG. 5 shows a perspective representation of the helmet shell according to FIG. 4 in an inclined view from below, FIG. 6 shows an exploded, partly cross sectional view of an embodiment of the protective helmet according to the applicant's prior suggestion in which it is provided with a face and ear protection, FIG. 7 shows the protective helmet according to FIG. 6 in a bottom view in which the face protection, a tightening unit and an ear protection are shown in a distance from the helmet, FIG. 8 shows an embodiment of the protective helmet according to the applicant's prior suggestion in which it comprises an ear protection, the helmet shell being shown in a cross section and the ear protection pivoted away from the ears, FIG. 9 shows the protective helmet according to FIG. 8, the ear protection, however, being shown pivoted onto the ears, FIG. 10 shows a side view of the protective helmet according to FIG. 9, FIG. 11 shows the protective helmet according to FIG. 10, the ear protection, however, being shown pivoted into a parking position and accommodated under the helmet shell, FIG. 12 shows the interior fitting subassembly of the protective helmet according to the applicant's prior suggestion, two ends of a neck strap being releasably connected in the neck area by means of a tightening unit, FIG. 13 shows the interior fitting subassembly according to FIG. 12 mounted in the helmet shell in a side view of the protective helmet according to the applicant's prior suggestion, FIG. 14 shows the protective helmet according to FIG. 13 in a view from below, FIG. 15 shows a cross sectional view of the protective helmet according to FIG. 13 when viewed in a rearward direction, FIG. 16 shows a partly broken representation of the protective helmet according to FIG. 13 when viewed in a forward direction, FIG. 17 shows the protective helmet according to FIG. 13 which is, in addition, shown with a visor as a face protection, the visor being opened, FIG. 18 shows a cross sectional view of the protective helmet according to FIG. 17 when viewed in a rearward direction, FIG. 19 shows a broken representation of the protective helmet according to FIG. 17 when viewed in a forward direction, FIG. 20 shows a side view of an embodiment of a protective helmet according to the applicant's prior suggestion provided with a face protection, an ear protection and a tightening unit attached to a neck strap in the area of the back of the head, FIG. 21 shows a rear part of the helmet shell provided with a retaining part for additionally fixing the supporting cage on the helmet shell in an enlarged scale as a detail of an embodiment of the protective helmet according to the invention, FIG. 22 shows the fixation of the rear part of the supporting cage on the helmet shell via a snap-on connection of a supporting arm protruding backwards and downwards of the supporting cage and via a bridge integrally formed with this supporting arm which is suspended from or supported by the retaining part in a view identical to FIG. 21, FIG. 23 shows an interior fixation subassembly of a protective helmet according to the invention in a view from behind, FIG. 24 shows the interior fixation subassembly according to FIG. 23 in a longitudinal side view, FIG. 25 shows the interior fixation subassembly according to FIGS. 23 and 24 in a perspective view as seen from obliquely behind and above, FIG. 26 shows a front view of another embodiment of the protective helmet according to the invention which is formed as a mountaineer's or tree climber's helmet here and is therefore additionally provided with a chin strap, FIG. 27 shows the protective helmet according to FIG. 26 in an inclined side view as seen from below, FIG. 28 shows the protective helmet according to FIG. 26 in a view from the rear side, FIG. 29 shows the protective helmet according to FIG. 26 in a side view, FIG. 30 shows a full plan view of the helmet shell of the protective helmet only partly shown in FIGS. 21 and 22, namely together with a ventilation gate, FIG. 31 shows the rear part of the helmet shell including the ventilation gate as a detail in a bottom view, FIG. 32 shows the ventilation gate according to FIG. 30 as a detail in a bottom view, FIG. 33 shows a plan view of the helmet shell of the protective helmet according to the invention with the ventilation gate dismounted, but interior fixation subassembly according to FIGS. 23-25 mounted, FIG. 34 shows the helmet shell with the interior fixation subassembly according to FIG. 33 mounted, however, in a view from below, and FIG. 35 shows a full bottom view of the helmet shell of the protective helmet only partly shown in FIGS. 30 and 31, namely again with the ventilation gate mounted, however in the ventilating position here.

An embodiment of a protective helmet according to the applicant's prior suggestion designated by 30 as a whole and formed particularly for the use in forestry is shown in a side view in FIG. 20 and in an exploded, partially sectional view in FIG. 6. The protective helmet 30 comprises a face protection designated by 32 as a whole and an ear protection designated by 34 as a whole. The protective helmet 30 further comprises a helmet shell 36 and an interior fitting subassembly designated by 40 as a whole and comprising a supporting cage 42, a head band 44 and a neck strap 46. The neck strap 46 is provided with a tightening unit designated by 48 as a whole. The helmet shell 36 is provided with a ventilation slide 50 on the outside by means of which ventilation orifices 52 formed in the helmet shell can be opened and closed.

Three supporting arms 54, 55 and 56 formed as spacers of which the supporting arm 55 is not visible in FIG. 6 serve as a means for a preferably deployed three-point fastening of the interior fittings or the interior fitting subassembly 40 on the helmet shell 36. The helmet shell 36 is dimensioned so (i.e. dimensioned so long and so wide in its inner width) and the supporting arms 54, 55 and 56 are dimensioned and arranged so that, between the interior fitting subassembly 40 and the helmet shell 36, a clearance 60 is present for accommodating ear protection capsules 35*a*, 35*b* of the ear protection 34 and other helmet accessories as well as mounting devices for at least the face protection 32, the ear protection 34, and a chin strap 300 (FIGS. 26-29). The other helmet accessories include the abovementioned tightening unit 48 of the neck strap 46.

In the following the helmet shell 36, the interior fitting subassembly 40, its connection to the helmet shell 36 and then the helmet accessories comprising the ear protection 34, the face protection 32 as well as their mounting devices and the tightening unit 48 as well as the chin strap 300 and its fastening device 380 will be described in detail and in this order.

In the following, the helmet shell 36 will be described in detail with reference to the drawings, particularly to FIGS. 3-7 and 15.

The helmet shell 36 is formed as an integrally formed plastics moulding. A suitable plastic material for the helmet shell 36 is, for example, ABS. In FIG. 3, a longitudinal sectional view of the helmet shell 36 equipped with the interior fitting subassembly 40 is shown. FIG. 4 shows the helmet shell 36 according to FIG. 3 without the interior fitting subassembly 40 in a view from below. FIG. 5 shows a perspective representation of the helmet shell according to FIG. 4 in an inclined view from below. FIG. 6 shows an exploded, partially sectional view of the protective helmet 30, the helmet shell 36 and, above it, the ventilation slide 50 being visible from above in this representation. FIG. 7 shows a bottom view of the protective helmet 30 according to FIG. 6 in the assembled state in which the face protection 32, the tightening unit 48 and the ear protection 34 are shown in a distance to the helmet. The helmet shell 36 is drawn forward to an extent that it also fulfills the function of a peak above the eyes. In this way the helmet shell 36 has, in its front section, a uniformly ascending outer surface without any considerable gradation in the backward direction so that it does not offer any catching points to obstacles such as branches. On the inner surface of the helmet shell 36 transversely extending reinforcement ribs 62 are integrally formed in the front and in the central section of the helmet. Transverse to the reinforcement ribs 62 and centrally a reinforcing rib 64 extending in the longitudinal direction of the protective helmet 30 is formed. The reinforcement ribs 62 and 64 are best seen in FIGS. 3 and 4. In the central area the reinforcement ribs 62, 64 connect to an area slightly deepening towards the inside and comprising six sets of ventilation orifices 52. In the deepened area the ventilation slide 50 engaging in two front guiding slots 66 with retaining cams 68 protruding downwards and inwards and in two rear guiding slots 72 with two retaining cams 70 is shiftably located on the outer surface of the helmet shell 36. The ventilation slide 50 has congruent ventilation orifices 53 (FIG. 6) located above the ventilation orifices 52 in the ventilation position and disposed in a shifted position so that the ventilation orifices 52 are closed by the ventilation slide 50 in the closed position.

The lower edge of the helmet 30 is laterally drawn downwards in the area of the temples and in the area of the back of the head as can be seen in FIGS. 5 and 11. In this way the above-mentioned clearance 60 between the interior fitting subassembly 40 and the helmet shell 36 is enlarged in the downward direction in these areas. In this way the mounting of mounting devices to the inside of the helmet shell 36 and the accommodation of the ear protection capsules 35*a*, 35*b* in the clearance 60 is facilitated which is illustrated in the representation in FIG. 11 and described in more detail below.

In the abovementioned temple area three rod-like protrusions 74*a* or 74*b* to which the interior fitting subassembly 40 including the supporting arms 54 or 55 can be positively and releasably attached are integrally formed on each side of the inside of the helmet shell 36. The rod-like protrusions 74*a*, 74*b* can be seen in a side view in FIG. 5, in a plan view in FIG. 4 (on the right side) and in a sectional view in FIG. 15. The rod-like protrusions 74*a*, 74*b* are, in the cross-section, square hollow profiles, respectively, the base section of which is integrally formed on the inside of the helmet shell 36. In their sector opposing the base section the rod-like protrusions 74*a*, 74*b* are arranged so that they stand freely in front of the inner surface of the helmet shell 36. The connection of the rod-like protrusions 74 to the inside of the helmet shell 36 and their transition to the helmet shell in the area adjacent to the connecting point in a respectively triangular knuckle is stiffened by additional integrally formed ribs between the rod-like protrusions 74*a*, 74*b* and the helmet shell 36 so that the rod-like protrusions 74*a*, 74*b* are substantially rigidly connected to the helmet shell 36. If a force transverse to their longitudinal direction and aiming at bending the rod-like protrusions is applied to the rod-like protrusions 74*a*, 74*b* the rod-like protrusions 74*a*, 74*b* aim at deforming the helmet shell 36 correspondingly. The purpose of this design is explained in more detail in connection with the description of the attachment of the interior fitting subassembly 40 to the helmet shell 36 further below.

At the centre of the rear end the helmet shell 36 is provided with a recess 76 at the lower edge behind which the tightening unit 48 of the neck strap 46 is located so as to be accessible for a manual operation for tightening or releasing the neck strap 46 when the helmet 30 is fully assembled.

To lock the supporting arm 56 on the helmet shell 36 it is provided with at least one slot 78 in the area of the back of the head in which the appropriately formed free end of the supporting arm 56 (FIG. 2) can releasably engage as shown in FIGS. 7 and 15. If the supporting arm 56 is engaged protrusions 56*a*, 56*b* formed on the supporting arm 56 are located outside of the helmet shell 36 and abut to its outer surface so that a tensile load is applied to the supporting arm 56 when a force acts on the helmet shell 36 from above.

A mounting device 80 for the ear protection 34 comprises two ear protection supporting points 80*a*, 80*b* on the inside of the helmet shell 36. The ear protection supporting points 80*a*, 80*b* are pivot bearings integrally formed on the inside of the helmet shell 36 or, preferably, non-releasably mounted as additional parts. On the ear protection supporting points 80*a*, 80*b*, supporting brackets 37*a*, 37*b* including ear protection capsules 35*a* or 35*b* are pivotably supported as described in more detail further below.

A mounting device 84 for the face protection 32 is provided with two face protection supporting points 84*a*, 84*b* on the inside of the helmet shell 36. In the face protection supporting points 84*a*, 84*b* two retaining arms 132*a*, 132*b* of a visor 132 are pivotably supported. The face protection supporting points 84*a*, 84*b* are not integrally formed on the inside of the helmet shell 36 but respectively fit onto a connector 136*a* or 136*b* respectively snapped on the rod-like protrusions 74*a* or 74*b* to thereby simultaneously fix the free ends of the supporting arms 54, 55 on the rod-like protrusions. The face protection supporting points 84*a*, 84*b* including the connectors 36*a* or 36*b* allocated to them are located in the clearance 60 in the mounted state, namely in an area in which the helmet shell 36 is drawn downward at its lower edge as already explained above.

The interior fittings for the protective helmet 30 will be described in detail below with reference to the drawings, particularly FIGS. 1-3, 6 and 12. The interior fitting subassembly 40 is that part of the protective helmet 30 which contacts the head and comprises the supporting cage 42, the head band 44 and the neck strap 46 equipped with the tightening unit 48. The subassembly 40 can be attached to the helmet shell 36 shown in FIGS. 3 and 6 so as to support and fix the helmet 30 on the head of a wearer.

FIG. 1 shows the interior fitting subassembly 40 of the protective helmet 30 according to the invention in a perspective representation and in an inclined view from below. FIG. 2 shows the interior fitting subassembly according to FIG. 1 in an inclined view from above. FIG. 3 shows a longitudinal sectional view of the interior fitting subassembly 40 according to FIG. 1 mounted in the helmet shell 36 of the protective helmet 30 also shown in a longitudinal section. FIG. 6 shows an exploded, partially sectional representation of an embodiment of the protective helmet 30 in which it is provided with a face and an ear protection 32 and 34. FIG. 12 shows the interior fitting subassembly 40 of the protective helmet 30, two ends of the neck strap 46 being releasably connected by the tightening unit 48 in the neck area.

The supporting cage 42 is formed of a stiff, elastically flexible material, preferably of a plastic material such as polyamide. The support head 42 is respectively provided with a rigid supporting arm 54, 55 or 56 protruding obliquely downwards or backwards and downwards in two temple areas as well as in an area of the back of the head to form a three-point mount of the interior fittings to the helmet shell 36 and for enabling the clearance 60 continuously extending around the interior fittings in the helmet shell 36 to accommodate ear protection capsules 35*a*, 35*b* and other helmet accessories as well as mounting devices 80, 84 for the face and the ear protection 32 and 34. The supporting cage 42 is produced as an integrally formed plastic moulding in the embodiment described here. The supporting cage 42 is formed of two pairs of mutually spaced apart support strips 142, 144 which, according to the representation in FIG. 2, intersect in the centre, their lower ends blending into a single, peripherally closed support strip 148 at four connection points 146*a*, 146*b*, 146*c*, 146*d*. In FIG. 1 the support strips 142, 144 are hidden by a cross-shaped piece of padding material 149.

The supporting arms 54, 55, 56 protrude downwards from the supporting cage 42 at the connection points 146*a*, 146*b*, 146*c*. If it is assumed that the support strips 142 and 144 extend in a curve, preferably in a substantially circular arc, between the connection points 146*a*, 146*b* or 146*c*, 146*d* the supporting arms 54, 55 or 56 respectively protrude laterally downwards or backwards and downwards from the supporting cage 142 so as to be substantially tangential to the related curve as can be seen in FIG. 15 or 2. In the embodiment described here the supporting arms 54, 55, 56 are integrally formed on the peripherally closed support strip 148. The head band 44 is integrally formed on the supporting cage 42 as shown in FIG. 2. The neck strap 46 has two front ends releasably connected to free rear ends of the head band 44, for example by means of a snap-on connection not shown in detail in the Figures. The neck strap 46 has, according to the representation in FIGS. 1 to 3, two free ends releasably connected to each other in the neck area, namely with the aid of the tightening unit 48 as can be seen in FIG. 12. The neck strap 46 may be formed of the same material as the supporting cage 42. The neck strap 46 is respectively connected to the supporting cage 42 between its connections to the head band 44 and its free ends so that it is adjustable in height as illustrated, for example, in FIGS. 1 and 2. To this end the supporting cage 42 comprises two support arms 47*a*, 47*b* protruding downwards on which the neck strap 46 is respectively fixable at a selectable height. The neck strap 46 has three holes 51 arranged above each other on each side which can be brought in engagement on a resilient bolt 49 protruding from each support arm 47*a*, 47*b* (FIG. 6) as illustrated in FIGS. 1 and 2.

In the embodiment described above the supporting arms 54, 55 are, actually, attached to the helmet shell 36 in a different way from the supporting arm 56 however, this is not essential. The supporting arms 54, 55 may also be fixed to the helmet shell in the same way as the supporting arm 56 To this end, it would only be required that the supporting arms 54, 55 have fixation means identical to those of the supporting arm 56 which permit the supporting arms 54, 55 to be brought into a positive engagement with the helmet shell. In this case then the fixation means of the supporting arms 54, 55 would also be locking means which are, for example, inserted into slots in the helmet shell 36 to fix the supporting arms 54, 55 as well as the supporting arm 56 on the helmet shell by means of a locking connection.

The head band 44 is integrally formed on the peripherally closed support strip 148 via connecting strips 150 in a distance to the peripherally closed support strip 148. The supporting arms 54, 55, 56 and the support arms 47*a*, 47*b* are further reinforced by integrally formed ribs 152 or 154.

The supporting arms 54, 55 protruding laterally downwards in the two temple areas comprise means for the fixation to the inside of the helmet shell 36. The fixation means comprise three through-holes 156 or 158 in each of the supporting arms 54, 55 which can be brought into a positive engagement with the rod-like protrusions 74*a* or 74*b* on the helmet shell 36. The supporting arm 56 of the supporting cage 42 protruding backwards in the area of the back of the head is provided with the protrusions 56*a*, 56*b* which, as already explained above, form a locking device for releasably attaching the interior fitting subassembly 40 to the helmet shell 36.

In industrial and forestry workers' helmets a chin strap is usually fastened to the helmet shell or to the supporting cage. In the protective helmet 30' according to the invention the chin strap 300 (FIGS. 26-29) is fixed to the helmet shell 32 and the supporting cage 42 for its use particularly as a mountaineer or tree climber helmet, said fixation being described in more detail further below.

The mutual connection of the helmet shell 36 and the interior fitting subassembly 40 which was already partly described above will be explained in summary and complementary here with reference to FIGS. 2, 3 and 15. FIG. 2 shows the interior fitting subassembly 40 in a perspective representation and in an inclined view from above. FIG. 3 shows a longitudinal sectional view of the interior fitting subassembly 40 mounted in the helmet shell 36 of the protective helmet 30 also shown in a longitudinal section, the tightening unit 48 on the neck strap 46 not being shown.

FIG. 15 shows a sectional view of the protective helmet 30 along the line XV-XV in FIG. 3, the tightening unit 48 also being shown. In FIG. 2, the supporting arms 55 and 56 formed as spacers can be seen. The second supporting arm 55 protruding downwards cannot be seen in FIG. 2. The supporting arm 55 is shown in an interior view in FIG. 3. In FIG. 15 the supporting arms 54 and 55 are shown in a sectional view. For the three-point attachment of the interior fitting subassembly 40 to the helmet shell 36 the supporting arm 56 protruding backwards and downwards is inserted into the slot 78 in the helmet shell until the protrusions 56*a*, 56*b* engage on the outside of the helmet shell. Then the interior fitting subassembly 40 is moved further inwards in the direction of the inner surface of the helmet shell 36, the supporting arms 54 and 55 being slipped over the rod-like protrusions 74*a* or 74*b*. At the same time the through-holes 156 and 158 in the supporting arms 54 and 55 positively accommodate the rod-like protrusions 74*a* or 74*b* as can be seen in FIG. 15. If the supporting arms 54, 55 abut on the interior surface of the helmet in the knuckle between the helmet shell 36 and the rod-like protrusions 74*a*, 74*b* the connectors 136*a* and 136*b* (FIGS. 4 and 5) are fitted onto the rod-like protrusions 74*a* or 74*b* to thereby fix the supporting arms 54 and 55 in their position. The interior fitting subassembly 40 and the helmet shell 36 are now fixedly connected to each other at three points. As soon as the protective helmet 30 is placed on the head and fixed to the head with the aid of the tightening unit 48, in addition, a chin strap (not shown) may also be tightened under the chin, if required. The through-holes 156, 158 in the supporting arms 54, 55 respectively encompass the rod-like protrusions 74*a* or 74*b* on a length at least equal to the inner width the through-holes 156, 158. If, due to a load acting on the helmet 30, a force is exerted on the supporting arms 54, 55, 56 from above a tensile load is applied to the supporting arms by the helmet shell 36 supported by the ends the supporting arms. A momentum aiming at deforming the helmet shell 36 inwards as far as to the lower edge is generated at each of the three points by this force acting on the supporting arms 54, 55, 56. The helmet shell 36 thus transforms part of the force acting on it into deformation energy and, in this way, reduces the force effect acting on the person wearing the helmet. The transmission of the momentum from the supporting arms 54, 55, 56 to the helmet shell 36 is further increased by the support arms being further reinforced by integrally formed ribs 152.

In the following the ear protection 34 including its mounting device 80 will be described in more detail with reference to the drawings, particularly FIGS. 4-11. FIG. 4 shows the helmet shell 36 without the interior fitting subassembly 40 in a view from below, particularly the position of the ear protection supporting points 80*a*, 80*b* on the inside of the helmet shell 36 being discernible. FIG. 5 shows a perspective representation of the helmet shell 36 according to FIG. 4 in an inclined view from below. FIG. 6 shows an exploded, partially sectional view of the protective helmet 30, the ear protection 34 being shown in relation to the other helmet accessories. FIG. 7 shows a bottom view of the protective helmet 30 in which the ear protection 34 is shown in a distance to the helmet. The mirror-inverted ear protection 34 present on the opposite side of the helmet 30 was omitted in FIG. 7 for the sake of clarity. FIG. 8 shows the protective helmet 30 including the ear protection 34 present on both sides, the helmet shell 36 being shown in a cross-sectional view and the ear protection 34 being shown when pivoted away from the ears. FIG. 9 shows the protective helmet according to FIG. 8, the ear protection 34, however, being shown when pivoted onto the ears. FIG. 10 shows a side view of the protective helmet according to FIG. 9. FIG. 11 shows the protective helmet according to FIG. 10, the ear protection 34, however, being shown when pivoted backwards into a parking position and accommodated under the helmet shell.

The ear protection 34 comprises two ear protection capsules 35*a*, 35*b* which are, respectively, pivotably supported in a fork-like supporting bracket 37*a* or 37*b*. The helmet shell 36 is provided with the fixed ear protection supporting points 80*a*, 80*b* at its inner side as can be seen in FIG. 4. In FIG. 6 the ear protection supporting point 80*b* is, in fact, illustrated together with the supporting cage 42, however, this supporting point is, like the ear protection supporting point 80*b*, attached to the inside of the helmet shell 36 and not to the supporting cage 42. The representation in FIG. 6 is only to illustrate where in space the ear protection supporting point 80*b* is located in relation to the supporting cage 42 of the interior fitting subassembly 40. At the supporting points 80*a*, 80*b*, the supporting brackets 37*a*, 37*b* provided with the ear protection capsules 35*a* or 35*b* are pivotably supported as can be seen in FIGS. 10 and 11. The ear protection supporting points 80*a*, 80*b* and the supporting brackets 37*a*, 37*b* are arranged and formed so that the supporting brackets 37*a*, 37*b* are pivotable between two positions inside the clearance 60, an operating position shown in FIGS. 9 and 10 in which the ear protection capsules 35*a*, 35*b* cover the ears, and a parking position shown in FIG. 11 in which the ear protection capsules 35*a*, 35*b* are accommodated in the clearance 60 in the helmet shell 36.

Each supporting bracket 37*a*, 37*b* is formed so as to be spring-biased and bendable in an area between its two ends in which it extends within the clearance 60 so that the ear protection capsules 35*a*, 35*b* are respectively pivoted away from the ear in a non-bent posture of each supporting bracket 37*a*, 37*b* as shown in FIG. 8, and are respectively pivoted onto the ear in a bent posture of the supporting bracket 37*a*, 37*b* as shown in FIG. 9. If the protective helmet 30 is not positioned on the head the two ear protection capsules 35*a*, 35*b* respectively reach a position in the latter portion which is located substantially further inside than the ear each ear protection capsule 35*a*, 35*b* is to rest against. In other words, the mutual distance of the ear protection capsules is, in this case, substantially smaller than the mutual distance between the ears. In this way it is ensured that, when the helmet 30 is put on, the ear protection capsules 35*a*, 35*b* are maintained pressed onto the ears by means of the spring bias. The spring bias for bending each supporting bracket 37*a*, 37*b* between two defined positions is effected by a circularly bent yoke spring 92*a*, 92*b* (the latter can be seen in FIG. 6). Each supporting bracket 37*a*, 37*b* can be manually moved into a bent and a non-bent position. In each of these positions the yoke spring 92*a* or 92*b* causes an end position lock. The end position lock of the supporting brackets 37*a*, 37*b* is not reached when the helmet is put on because, as stated, each ear protection capsule 35*a*, 35*b* is to be held elastically pressed onto the ear.

Furthermore, each ear protection supporting point 80*a*, 80*b* and each supporting bracket 37*a*, 37*b* are formed so that the supporting bracket can only be pivoted backwards from the position shown in FIG. 8. In this way it is ensured that the ear protection capsules 35*a*, 35*b* can be accommodated in the clearance behind the ear without colliding with the ears and the lower edge of the helmet shell 36.

In the following the face protection 32 will be described in more detail with reference to the drawings, particularly FIGS. 6, 7 and 17-20. FIG. 6 shows the protective helmet 30 in an exploded and partially sectional representation, the face protection 32 being illustrated in relation to the other helmet accessories. FIG. 7 shows a bottom view of the protective helmet 30 in which a visor 132 of the face protection 32 is illustrated in a distance to the helmet. FIG. 17 shows the protective helmet 30, the visor 132 being opened. FIG. 18 shows a cross sectional view of the protective helmet according to FIG. 17 when viewed in a backwards direction. FIG. 19 shows the protective helmet according to FIG. 17 in of a broken representation when viewed in a forward direction. FIG. 20 shows a side view of an embodiment of the protective helmet 30 provided with the ear protection 34 and a tightening unit 48 attached to the neck strap 46 in the area of the back of the head in addition to the face protection 32.

The face protection 32 comprises the visor 132 comprising the two retaining arms 32*a*, 32*b* as well as two connectors 136*a*, 136*b* on which a face protection supporting point 84*a* or 84*b* is integrally formed as a mounting device 84 for the face protection 32, respectively. The connectors 136*a*, 136*b* are fitted on the rod-like protrusions 74*a* or 74*b* whereby the face protection supporting points 84*a*, 84*b* come to be positioned in the temple area on the inside the helmet shell 36. The connector 136*b* including the face protection supporting point 84*b* can be seen in FIG. 4. The connector 136*a* located on the opposite side and including the face protection supporting point 84*a* is not shown in FIG. 4. Each face protection supporting point 84*a*, 84*b* comprises three axially protruding, elastically flexible cams 85*a* or 85*b* via which the retaining arms 132*a*, 132*b* including ring-shaped bearing bushes 134*a*, 134*b* are shiftable to releasably and pivotably fix the retaining arms 132*a*, 132*b* in the face protection supporting points 84*a*, 84*b*. The face protection supporting points 84*a*, 84*b* and the retaining arms 132*a*, 132*b* are arranged and formed so that each retaining arm 132*a*, 132*b* is pivotable between two positions within the clearance 60, an operating position in which the visor 132 is closed and protects the face (FIG. 20), and a parking position in which the visor 132 is open and positioned on the outer surface of the helmet shell 36 so as to be closely abutting to it (FIGS. 17 and 19). The mounting device 84 for the face protection comprises a self-retaining mount for each retaining arm 132*a*, 132*b*. For this purpose, each connector 136*a*, 136*b* contains a spring-biased bolt retaining the ring bearing bushing 134*a* or 134*b* attached to the retaining arms 132*a*, 132*b* in the operating position or in the parking position in an elastically biased state.

The visor 132 forms a fork together with each retaining arm 132*a*, 132*b* (FIG. 6) in which the wall of the helmet shell 36 is tightly accommodated when the visor is open (FIG. 17). When the visor 132 is closed it abuts to the front edge of the helmet shell 36 with its upper edge, and the lateral edges of the visor 132 abut to the outer surface of the helmet shell. Therefore the possibility that, in the use of the helmet, for example in forestry work, branches might get caught on the retaining arms 132*a*, 132*b* or the visor 132 itself and imperil the wearer of the helmet is neither given when the visor is closed nor when it is open.

In the following the tightening unit 48 will be described in more detail. Alongside the ear protection 34, the tightening unit 48 is another helmet accessory which, like the ear protection 34, is always located within the perimeter of the helmet shell 36 so that, in the area of the tightening unit 48 as well, no protruding parts exist on which obstacles might get caught. The tightening unit 48 will be described with reference to the drawings, particularly to FIGS. 12-16. FIG. 12 shows a side view of the interior fitting subassembly 40 of the protective helmet 30 in which the two ends of the neck strap 46 are releasably connected by the tightening unit 48 in the neck area. FIG. 13 shows the interior fitting subassembly according to FIG. 12 mounted in the helmet shell 36 in a side view of the protective helmet 30, the tightening unit 48 being shown in the tightened state like in FIG. 12. FIG. 14 shows the protective helmet according to FIG. 13 in a view from below. FIG. 15 shows a cross sectional view of the protective helmet 30 when viewed in a backwards direction. FIG. 16 shows a partly broken representation of the protective helmet 30 according to FIG. 13 when viewed in the forward direction.

The tightening unit 48 comprises a mount 168 into which the free ends of the neck strap 46 are inserted on both sides. The mount 168 is provided with angular cams which can be brought in engagement with angular orifices 176 of the neck strap 46. In this way the length of the neck strap 46 can be crudely adjusted depending on the size of the head. The adjustment is appropriately carried out so that the protective helmet 30 can be conveniently put on when the tightening unit is not operated. The tightening of the neck strap 46 will then be effected with the aid the tightening unit 48 after the helmet 30 was put on as explained below.

According to the representation in FIG. 14 the supporting shell 172 and the mount 168 are jointedly connected to each other by means of a transfer lever 169. According to FIG. 14, the transfer lever 169 is, at one end, connected to the, in FIG. 12, lower end of the supporting shell 172 by means of a joint 170. According to FIG. 16, the transfer lever 169 is connected to an, according to the representation, upper end of the mount 168 by means of a joint 171 at its other end.

The tightening unit 148 is operated by means of a latch flap 174 which is, according to FIG. 12, connected to the mount 168 by means of a joint 173. The latch flap 174 is provided with a cam not shown in the drawings below the joint 173 on its side adjacent to the transfer lever 169. If the latch flap 174 is closed as shown in FIG. 12 the lower end of the mount 168 is pivoted backwards away from the joint 170 by the effect of the cam on the transfer lever 169. Said pivoting causes a tightening of the neck strap 46. In the process, the tightening unit 48 is supported by the supporting shell 172 in the neck area at the back of the head. A spring not illustrated in the drawings is allocated to the joint 171, said spring being positioned between the mount 168 and the transfer lever 169 so that the joint 170 of the transfer lever 169 is urged into the direction towards the lower end of the mount 168 when the latch flap 174 is opened. In the area of the joint 170 another spring (also not shown) is effective between the supporting shell 172 and the transfer lever 169 and aims at urging the supporting shell 172 into a position on a stopper in which its upper end is pivoted away from the upper end of the mount 168.

The operation of the tightening unit 48 is effected by means of the latch flap 174. If the latch flap 174 is pivoted clockwise and thus closed as shown in FIG. 12 the mount 168 is pivoted about the joint 171 so that the, according to the representation in FIG. 12, lower edge of the supporting shell 172 is spaced apart from the lower edge of the mount 168. This is the tightened position of the tightening unit which can be seen in FIGS. 12-14. If the latch flap 174 is pivoted counter-clockwise and thus opened the tightening unit 48 is opened. As a result the lower edge of the mount 168 can move in the direction toward the joint 170 on the supporting shell 172 so that the neck strap 46 is released and the protective helmet 30 can be put on or taken off. If the protective helmet 30 has been put on the latch flap 174 only has to be pivoted downwards to fix the helmet 30 on the head. This can be conveniently done with one hand and also while wearing a glove. On the front side the supporting shell 172 is covered by a piece of padding material 180.

Now, an embodiment of the protective helmet 30' according to the invention mainly differing from the embodiment of the protective helmet 30 according to the applicant's prior suggestion in an additional stabilisation of the fixation points of the supporting 55 arm protruding backwards and downwards of the interior fixation subassembly 40 and in the accordingly modified embodiment of the fixation of this supporting arm on the helmet shell will be described with reference to FIGS. 21-25 and 33, 34.

Another difference is the provision of the chin strap 300 and its type of fixation on the helmet shell 36 and the interior fixation subassembly 40 according to the illustration in FIGS. 26-29.

Finally, yet another difference resides in the design of the fixation of the ventilation gate 50' which is tailored to the modified fixation of the supporting arm 56 on the helmet shell 36 according to the illustration in FIGS. 30-32 and 35.

The protective helmet 30 according to the applicant's prior suggestion can be provided with a helmet shell and interior fixation subassembly adapted to the differences described above and will then be equivalent to a protective helmet 30' according to the present invention in all embodiments shown here and described for the prior suggestion which may then optionally be provided with a face protection, an ear protection and/or a tightening unit for the head band. The type of attachment of this helmet accessory would not differ from the type of attachment in the protective helmet 30 according to the applicant's prior suggestion so that the drawings and the description of the protective helmet 30 according to the applicant's prior suggestion are enclosed here for the sake of simplicity so as to avoid an additional illustration and description of the protective helmet 30' according to the invention and of the mentioned helmet accessories and the associated repetitions which would be involved. The protective helmet 30 according to the applicant's prior suggestion, supplemented by the differences described above, is the protective helmet 30' and therefore part the present invention.

FIG. 21 shows a rear part of the helmet shell 36 provided with a retaining part 210 illustrated om FIG. 21 for an additional fixation of the supporting cage 42 on the helmet shell 236 as a detail of an embodiment of the protective helmet according to the invention altogether designated by 30' shown in an enlarged scale. The retaining part 210 is formed as a protruding cam. The retaining part 210 is formed on a wall 220 (FIG. 31) integrally formed on the inner side of the helmet shell 36. It is self-understood that, a corresponding second wall 222 (FIG. 31) provided with a retaining part 211 opposing the retaining part 210 is formed on the opposite side of the helmet shell 36, i.e. in the same distance from a longitudinal central axis of the helmet shell. Between the two walls 220, 222 two slots 178, 179 positioned transverse to the central axis of the helmet shell 36 and having a rectangular cross section are provided for inserting two bifurcated ends 157*a*, 157*b* (FIG. 23) of the supporting arm 56 protruding backwards and downwards. A releasable fixation of the supporting arm 56 protruding backwards and downwards is implemented with the aid of a latch lock effective in its longitudinal direction on a rear fixation point on or in the helmet shell (in the shown embodiment in the helmet shell) and in an additional fixation point by means of a mounting suspension or support of the supporting arm 56 above (as shown) or below (not shown) the latch lock on the inside of the helmet shell 36, namely by means of the two opposing retaining parts 210, 212 on both sides of the central longitudinal axis which are formed as cams. For connecting the supporting arm 56 protruding backwards and downwards to the additional fixation point an intermediate part 200 of the supporting arm 56 disposed in the clearance 60 is fixed on the retaining parts 210, 212 on the helmet shell 36 disposed in a distance above it in the embodiment shown.

The helmet shell 36 including the mounted interior fixation subassembly 40 is, in its entirety, shown in a plan view in FIG. 33 and in a bottom view in FIG. 34. The interior fixation subassembly 40 actually also comprises the neck strap 46 which is, however, not shown in FIGS. 22-25, 33 and 34 for the sake of simplicity.

For its latch lock on the helmet shell 36 the supporting arm 56 protruding backwards and downwards has a latching device formed by the two bifurcated ends 157*a*, 157*b* and the slots 178, 179 on its free end. Each bifurcated end 175*a*, 177*b* narrows in the area of its protrusion 56*a* or 56*b* towards its free end, namely from a aperture 159*a* or 159*b*. During the assembly of the interior fixation subassembly 40 the helmet shell 36 is positively accommodated in the openings 159*a*, 159*b*. The intermediate part 200 of the supporting arm 56 is then positioned in the clearance 60 present between the inner side of the helmet shell 36 and the supporting cage 42 as soon as the interior fixation subassembly 40 is mounted in the helmet shell.

The intermediate part 200 (FIG. 24) of the supporting arm 56 protruding backwards and downwards disposed in the clearance 60 is provided with two bridges 212, 214 protruding upwards (FIG. 25) for its additional mounting suspension or support in the additional fixation point on the helmet shell 36. The bridges 212, 214 are integrally formed with the supporting arm 56. Each of the bridges 212, 214 is provided with an aperture 228 or 230 at its free end so that it is positively fixable on the retaining part 210 or 212 on the helmet shell 36. As mentioned above, the retaining parts 210, 212 are formed as cams.

The supporting arm 56 protruding backwards and downwards is latched in the slots 178, 179 at its two bifurcated ends 157*a*, 157*b* on the helmet shell 36 in the manner described above. The bridges 212, 214 are aligned in parallel relative to each other and spaced apart by the width of the supporting arm 56. The supporting arm 56 protruding backwards and downwards forms an angle β in a range of approx. 15°-25° with a longitudinal axis 242 of the supporting cage 42 (FIG. 24).

For mounting the interior fixation subassembly 40 in the helmet shell 36 the interior fixation subassembly 40 is fit on the rod-like protrusions 74*a*, 74*b* on the helmet shell 36 with the fixation means on each of the supporting arms 54, 55 protruding laterally downwards which comprise through holes 156, 158. Prior to this, the supporting arm 56 protruding backwards and downwards is inserted into the slots 178, 179 with its bifurcated ends 157*a*, 157*b* until the helmet shell 36 is latched in the slots 178, 179. Then, the supporting arms 54, 55 protruding laterally downwards will abut on the base of the rod-like protrusions 74*a*, 75*b*. In the course of this process the two bridges 212, 214 have been shifted on the walls 220, 222 until openings 228, 230 formed in the bridges 212, 214 are latched on the retaining parts 210, 212 as shown in FIG. 22.

As already explained above, the inclination angles formed by the supporting arms 54, 55 protruding laterally downwards and the supporting arm 56 protruding laterally backwards and a horizontal plane or an axis located in this plane constitute essential embodiments of the invention. So the supporting arms 54, 56 protruding laterally downwards and a straight line 244 extending perpendicular to the longitudinal axis 242 of the supporting cage 42 and through the free ends of said supporting arms 54, 55 form an angle α in a range of approx. 30°-50°. The supporting arm 56 protruding backwards and downwards and the longitudinal axis 242 of the supporting cage 42 form an angle β in a range of approx. 15°-25°. These angles are important for the force transmission into the helmet shell 36 so that it can be deformed so that it will optimally contribute to the overall damping capacity of the protective helmet 30' when a load is applied from above or also from the side. Above that, it is an essential embodiment of the protective helmet 30' according to the invention that the supporting arms 54, 55 protruding laterally downwards are swept-forward and formed on the supporting cage in front of the longitudinal centre of the supporting cage 42. The force transmission points are thereby shifted further towards the front side relative to the points on which the supporting arms 54, 55 are integrally formed on the supporting cage 42 whereby the force transmission into the helmet shell 36 is improved for the purpose of its enhanced deformability. Like in the protective helmet 30 described in the beginning the supporting cage 42 is formed of a stiff, elastically flexible material. On this supporting cage the supporting arms 54, 55 and 56 protruding laterally downwards and backwards and downwards are integrally formed, i.e. they consist of the same material. The supporting cage 42 is provided with the peripherally closed supporting strip 148 at its lower edge on which the supporting arms 54, 55, 56 are integrally formed. The neck strap 46 is likewise attached to the supporting cage 42 and has two ends releasably connected by a tightening unit 48 accommodated in the clearance 60 as another helmet accessory in the neck area in the supporting cage 42 according to the FIG. 23-25. The tightening unit 48 comprises a supporting shell 172 which can be tightened against the back of the head of a wearer of the helmet 30' with the aid of a latch flap 174 when the neck strap 46 is tightened.

The chin strap 300 constitutes a part of the helmet accessories of the protective helmet 30' according to the invention. The chin strap 300 has to be provided on a protective helmet used as a mountaineering or tree climbing helmet. Two chin strap fixation points 310 for the chin strap 300 are provided on the inside of the helmet shell 36 in front of the temple areas, 311 (FIG. 26). The two chin strap fixation points 310, 311 are part of a mounting device 380 for the chin strap 300. The chin strap 300 can be mounted in the chin strap fixation points 310, 311 by means of suspension links 314, 316. The mounting device 380 for the chin strap 300 further comprises a rear chin strap fixation point 312. The rear chin strap fixation point 312 is located on the interior fixation subassembly 40. The rear chin strap fixation point 312 comprises an aperture in the supporting arm 56 protruding backwards and downwards in which another mounting lug 318 of the chin strap 300 can be mounted. The suspension links 314, 316, 318 respectively comprise a protruding pin having a mushroom-like form. The aperture in which each mounting lug is mounted has a keyhole-like shape, i.e. it conically tapers from one end and then widens to a circular aperture. The mushroom-shaped pin of the mounting lug is guided between the conically tapering sides of the keyhole-shaped aperture until it is finally positioned in the following circular aperture.

The chin strap 300 is lead backwards to the tightening unit 48 from the two front chin strap fixation points 310, 311, run through the supporting shell 172 of the tightening unit 48 on both sides, and finally joined in the rear chin strap fixation point 312. Under each temple area the chin strap is lead to a redirecting lug 320 or 330. From the redirecting lug 320, the chin strap 300 extends under the chin to the other redirecting lug 330. In this area under the chin the chin strap 300 is additionally provided with a size adjustment lug.

When a tensile force is applied to the chin strap 300 its rear end on the supporting arm 56 which is led through the supporting shell 174 is pulled obliquely forward. In this way the fixation of the helmet on the head is stabilised. As a result of the additional fixation of the supporting arm 56 on the inner side the helmet shell 36 above of the supporting arm 56 via the bridges 212, 214 the tensile force of the chin straps 300 is optimally absorbed at their rear end. In this way the supporting arm 56 is prevented from being pulled out of the snap-on connection to the helmet shell 36 at its free end. Therefore, not only the snap-on connection between the supporting arm 56 and the helmet shell 36 is stabilised, but also the position of the rear chin strap fixation point 312. In this way it is possible for the supporting arm 56 to take up about 50% of the entire load introduced, while the supporting arms protruding laterally downwards can take up approximately 25%, respectively.

Figure 30:
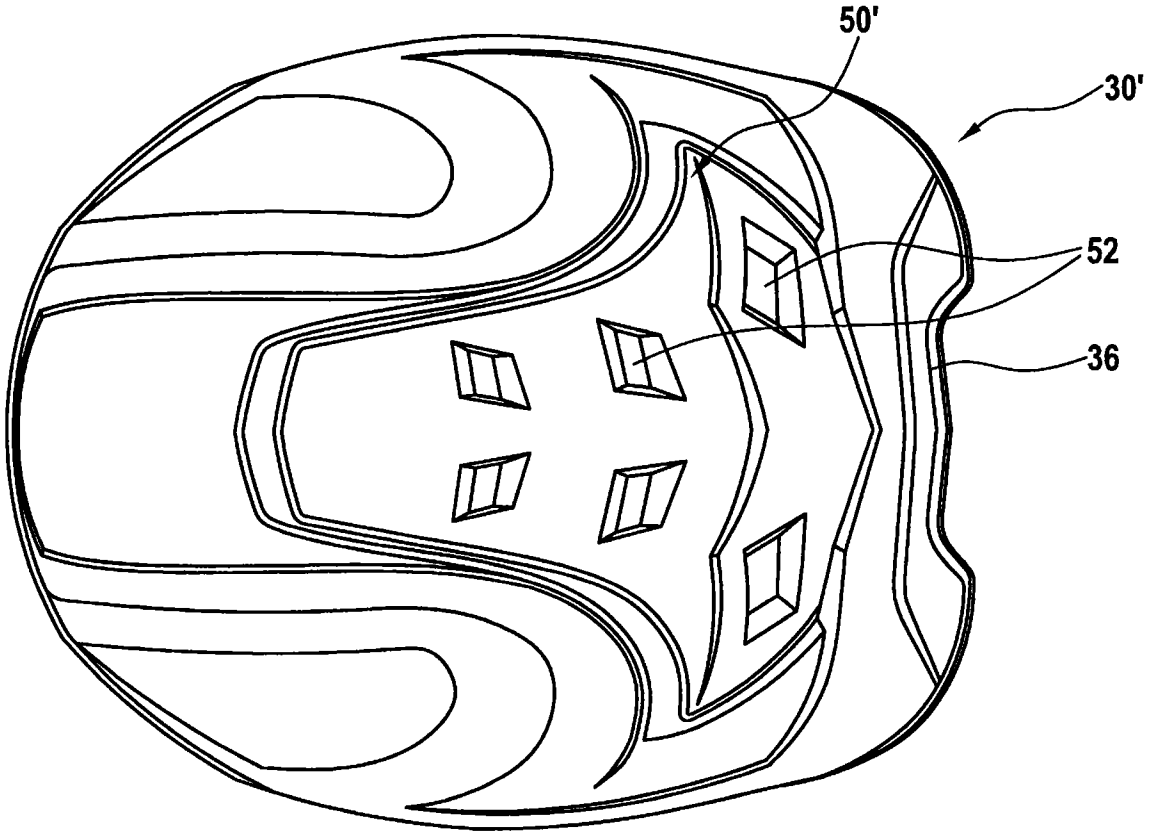

The helmet shell 36 of the protective helmet is provided with ventilation openings 53 and guide slots 250, 252, 260, 262 for retaining elements or cams of the ventilation gate 50' at least in an area following the snap-on connection point of the supporting arm 56 protruding backwards and downwards in the forward direction. The retaining elements of the ventilation gate 50' comprise a pair of angle elements 258, 260 in its front section and a pair of resiliently deflectable retaining arms 254, 256 in its rear section. The angle elements 258, 260 and the retaining arms 254, 256 are shiftably and releasably retained in their associated guide slots 260, 262 or 250, 252 when the ventilation gate 50' is mounted as can be seen in FIGS. 31 and 35. During the assembly the angle elements 258, 260 of the ventilation gate 50' are inserted into the guide slots 260, 262 from the outside (FIG. 30). Incidentally, the retaining arms 254, 256 are inserted into their guide slots 250 or 252, the arms being resiliently pushed apart until they have passed their associated guide slot. Then they spring back to their initial position and support themselves on walls 280 or 282 with cams 270, 272. The ventilation gate 50' has two important functions in the protective helmet 30' according to the invention. On the one hand it shields the section of the rear fixation point of the interior fixation subassembly 40 on the helmet shell 36 against the effects of an impact from the outside. On the other hand it can easily be replaced and therefore used as an exchangeable slider, i.e., ventilation gates in different colours can be kept on stock to personalise a protective helmet for its wearer. For example, the protective helmet of a foreman may be provided with a red ventilation gate 50', the protective helmet of an excavator operator with a green ventilation gate 50', etc. The ventilation gate 50' of the protective helmet 30' according to the invention renders this possible since it can be easily replaced by a ventilation gate 50' in another colour.

The invention claimed is:

1. A protective helmet comprising a helmet shell (6), comprising interior fittings comprising a subassembly for contacting the head comprised of at least a supporting cage, a head band and a neck strap, and comprising means for fixing this subassembly to the helmet shell, wherein the fixation means comprise at least three support arms formed as spacers which protrude laterally downwards from supporting cage in the temple area or rearwards and downwards in the area of the back of the head, the helmet shell and the support arms are dimensioned so that the interior fixation subassembly continuously spaced apart from the helmet shell along its entire outer circumference so that a clearance extending around the interior fixation subassembly on all sides for accommodating helmet accessories comprising at least ear protection capsules as well as supporting brackets and a tightening unit for the neck strap as well as mounting devices for the ear protection and for other helmet accessories comprising at least a face protection and a chin strap and its mounting device is present between the interior fixation subassembly and the helmet shell, and that the support arms are releasably fixed to the helmet shell at their free end, respectively, wherein the releasable fixation of the support arm protruding backwards and downwards comprises a latch lock effective in its longitudinal direction on a rear fixation point on the helmet shell and a mounting suspension or support effective in its transverse direction on an additional fixation point disposed on the inside of the helmet shell in a distance to the latch lock.

2. The protective helmet according to claim 1, wherein an intermediate part of the support arm protruding backwards and downwards disposed in the clearance is fixable or fixed on a retaining part on the helmet shell disposed above or below it in a distance for connecting the support arm protruding backwards and downwards to the an additional fixation point.

3. The protective helmet according to claim 1, wherein the supporting cage is formed of a stiff, elastically flexible material.

4. The protective helmet according to claim 1, wherein the mounting device for the chin strap comprises two chin strap fixation points on the inside of the helmet shell in which mounting lugs of the chin strap can be mounted, and a rear chin strap fixation point on the interior fitting assembly.

5. The protective helmet according to claim 4, wherein the rear chin strap fixation point comprises an orifice in the support arm protruding backwards and downwards in which another mounting lug of the chin strap can be mounted.

6. The protective helmet according to claim 1, wherein the supporting cage comprises a peripherally closed support strip at its lower edge on which the support arms are integrally formed.

7. The protective helmet according to claim 1, wherein the neck strap is attached to the supporting cage and has two ends which are releasably connected in the neck area by means of a tightening unit which is accommodated in the clearance as another helmet accessory.

8. The protective helmet according to claim 7, wherein in that the tightening unit comprises a supporting shell which can be tightened against the rear of the head of a wearer of the helmet when tightening the neck strap with the aid of a latch flap.

9. The protective helmet according to claim 8, wherein the chin strap is guided backwards to the tightening unit from the two front chin strap fixation points, lead through the supporting shell and finally joined in the rear chin strap fixation point.

10. The protective helmet according to claim 1, wherein the support arms protruding laterally downwards in the two temple areas comprise means for a releasable fixation on the inside of the helmet shell.

11. The protective helmet according to claim 10, wherein the fixation means on each of the support arms protruding laterally downwards is formed so that it can be brought in a positive engagement with the helmet shell.

12. The protective helmet according to claim 1, wherein the support arm protruding backwards and downwards comprises a locking device for its latch lock on its free end for fixing the support arm (56) to the helmet shell.

13. The protective helmet according to claim 11, wherein the fixation means on each of the support arms protruding laterally downwards comprise through-holes respectively encompassing rod-like protrusions on the helmet shell on a length which is at least equal to the inner width of the through-holes so that a force applied to the supporting arms protruding laterally downwards from above due to a load acting on the helmet generates a momentum at these support arms which strives to deform the helmet shell inwardly as far as to the lower edge.

14. The protective helmet according to claim 1, wherein the supporting cage comprises two support arms protruding downwards to which the neck strap is respectively fixable at a selectable height.

15. The protective helmet according to claim 14, wherein the supporting arms and the support arms are further stiffened by integrally formed ribs.

16. The protective helmet according to claim 2, wherein the intermediate part of the support arm protruding backwards and downwards disposed in the clearance is provided with at least one bridge protruding upwards or downwards for the additional mounting suspension or support in the additional fixation point on the helmet shell.

17. The protective helmet according to claim 16, wherein the bridge is integrally formed on the support arm (56) protruding backwards and downwards.

18. The protective helmet according to claim 2, wherein the bridge is formed so at its free end that it is positively fixable on the retaining part on the helmet shell.

19. The protective helmet according to claim 17, wherein the support arm protruding backwards and downwards is bifurcated at its free end and latched on the helmet shell at the two thus formed bifurcated ends and provided with a pair of the bridges aligned in parallel relative to each other and spaced apart by the width of the support arm protruding backwards and downwards in its intermediate part.

20. The protective helmet according to claim 1, wherein the support arms protruding laterally downwards form an angle in a range of 30°-50° with a straight line extending transversely with regard to the longitudinal axis of the supporting cage and through the free ends of said support arms.

21. The protective helmet according to claim 1, wherein the support arm protruding backwards and downwards forms an angle in a range of 15°-25° with the longitudinal axis of the supporting cage.

22. The protective helmet according to claim 20, wherein the support arms protruding laterally downwards are arrow-shaped in a forward direction and formed on the supporting cage in front of a central transverse axis of the supporting cage.

23. The protective helmet according to claim 1, wherein the helmet shell is provided with ventilation openings and guide slots for retaining elements of a ventilation gate at least in an area following the snap-on connection point of the support arm protruding backwards and downwards in the forward direction.

24. The protective helmet according to claim 23, wherein the retaining elements of the ventilation gate comprise a pair of angle elements in its front section and a pair of resiliently deflectable retaining arms in its rear section which are shiftably and releasably retained in their associated guide slots.

25. The protective helmet according to claim 23, wherein the ventilation gate is formed so that it shields the area of the helmet shell in which the support arm protruding backwards and downwards is fixable or fixed against the effect of impacts on the outside.

* * * * *